US006464810B1

(12) United States Patent
Nakamura et al.

(10) Patent No.: US 6,464,810 B1
(45) Date of Patent: Oct. 15, 2002

(54) BRASS MATERIAL, BRASS TUBE AND THEIR PRODUCTION METHOD

(75) Inventors: Katsuaki Nakamura; Toru Uchida, both of Kitakyushu (JP)

(73) Assignee: Toto Ltd., Kitakyushu (JP)

( * ) Notice: Subject to any disclaimer, the term of this patent is extended or adjusted under 35 U.S.C. 154(b) by 0 days.

(21) Appl. No.: 09/529,590

(22) PCT Filed: Oct. 22, 1998

(86) PCT No.: PCT/JP98/04786

§ 371 (c)(1),
(2), (4) Date: Apr. 17, 2000

(87) PCT Pub. No.: WO99/22039

PCT Pub. Date: May 6, 1999

(30) Foreign Application Priority Data

Oct. 24, 1997 (JP) ..... 9-309977
Oct. 2, 1998 (JP) ..... 10-296136

(51) Int. Cl.[7] ..... C22C 9/04

(52) U.S. Cl. ..... 148/684; 148/685; 148/412; 148/413; 420/476; 420/477

(58) Field of Search ..... 148/412, 413, 148/433, 434, 684, 685; 420/476, 477

(56) References Cited

U.S. PATENT DOCUMENTS 4,226,621 A * 10/1980 Ruchel ..... 148/433
5,766,377 A * 6/1998 Mueller et al. ..... 420/477
5,961,749 A * 10/1999 Ruchel ..... 420/477

FOREIGN PATENT DOCUMENTS

| | | | |
|---|---|---|---|
| JP | 49-23970 B1 | | 6/1974 |
| JP | 53-11121 A | | 2/1978 |
| JP | 56-18662 B2 | | 4/1981 |
| JP | 63-9573 B2 | | 2/1988 |
| JP | 63-29611 B2 | | 6/1988 |
| JP | 07-166279 | * | 6/1995 |
| JP | 7-68595 B2 | | 7/1995 |
| JP | 7-197150 A | | 8/1995 |

OTHER PUBLICATIONS

ASM Handbook, vol. 2, Properties and Selection, pp. 217, 218, 304–313, 318–321, 366 and 367, ASM International,. 1992.*

ASM Handbook, vol. 3, Alloy Phase Diagrams, pp. 1.18–1.23, ASM International, 1992.*

* cited by examiner

*Primary Examiner*—George Wyszomierski
(74) *Attorney, Agent, or Firm*—Frishauf, Holtz, Goodman & Chick, P.C.

(57) ABSTRACT

An object is to improve machinability and polishability of a brass material prepared through cold working, particularly in a brass pipe material. Before cold working, by having an α phase making heat treatment step for increasing an area ratio of an α phase, cold ductility can be ensured at the time of cold working. Also, after cold working, by having a β phase making heat treatment step for increasing an area ratio of a β phase, a brass material excellent in machinability and polishability can be provided.

40 Claims, 21 Drawing Sheets

| | | Example 1 | Example 2 | Example 3 | Example 4 | Comparative example 2 (C2700) |
|---|---|---|---|---|---|---|
| Component | Cu | 63.9% | 64.7 | 64.8 | 65.6 | 65.0 |
| | Sn | 0.91% | 0.91 | 1.2 | 1.2 | — |
| | Fe | 0.05% or less | Same as left | Same as left | Same as left | 0.05 or less |
| | Pb | 0.07% or less | Same as left | Same as left | Same as left | 0.05 or less |
| | Zn | Remainder | Same as left | Same as left | Same as left | Same as left |
| | Apparent Zn amount | 37.01% | 36.21 | 36.4 | 35.6 | 35.0 |
| Before cold drawing | Phase ratio (%): α/β | 95/5 | 98/2 | 94/6 | 97/3 | 100/0 |
| | Crystal grain size (μm) | 40 | 38 | 38 | 37 | 45 |
| Final pipe material | Phase ratio (%): α/β | 86/14 | 90/10 | 81/19 | 88/12 | 100/0 |
| | Crystal grain size | 16 | 18 | 15 | 17 | 30 |
| | Sn concentration in the phase (%): α/β | 0.7/2.2 | 0.7/2.8 | 0.9/2.5 | 0.9/3.4 | 0/— |
| | Polishiability | ○ | ○ | ○ | ○ | × |
| | Machinability | ○ | ○ | ○ | ○ | × |
| | Corrosion resistance | ○ | ○ | ○ | ○ | × |

Fig. 11

| | | Example 1 | Example 2 | Example 3 | Example 4 | Comparative example 2 (C2700) |
|---|---|---|---|---|---|---|
| Component | Cu | 63.9% | 64.7 | 64.8 | 65.6 | 65.0 |
| | Sn | 0.91% | 0.91 | 1.2 | 1.2 | — |
| | Fe | 0.05% or less | Same as left | Same as left | Same as left | 0.05 or less |
| | Pb | 0.07% or less | Same as left | Same as left | Same as left | 0.05 or less |
| | Zn | Remainder | Same as left | Same as left | Same as left | Same as left |
| | Apparent Zn amount | 37.01% | 36.21 | 36.4 | 35.6 | 35.0 |
| Before cold drawing | Phase ratio (%): α/β | 95/5 | 98/2 | 94/6 | 97/3 | 100/0 |
| | Crystal grain size (μm) | 40 | 38 | 38 | 37 | 45 |
| Final pipe material | Phase ratio (%): α/β | 86/14 | 90/10 | 81/19 | 88/12 | 100/0 |
| | Crystal grain size | 16 | 18 | 15 | 17 | 30 |
| | Sn concentration in the phase (%): α/β | 0.7/2.2 | 0.7/2.8 | 0.9/2.5 | 0.9/3.4 | 0/— |
| | Polishiability | ○ | ○ | ○ | ○ | × |
| | Machinability | ○ | ○ | ○ | ○ | × |
| | Corrosion resistance | ○ | ○ | ○ | ○ | × |

Fv Main component force
Ff Feed component force
Fp Back component force
R Combined force

Fig. 13 (a)

| | | Example 5 | Example 6 | Example 7 | Example 8 | Example 9 | Example 10 | Example 11 | Example 12 | Comparative example 1 (C2700) |
|---|---|---|---|---|---|---|---|---|---|---|
| Component | Cu | 63.00 | 64.40 | 63.60 | 63.60 | 64.90 | 64.10 | 63.00 | 63.00 | 65.00 |
| | Sn | — | 0.85 | 1.05 | 1.05 | 1.10 | 1.30 | 1.60 | 1.40 | — |
| | Fe | <0.05 | Same as left | Same as left | Same as left | Same as left | Same as left | Same as left | Same as left | Same as left |
| | Pb | <0.05 | Same as left | Same as left | Same as left | Same as left | Same as left | Same as left | Same as left | Same as left |
| | Zn | Remainder | Same as left | Same as left | Same as left | Same as left | Same as left | Same as left | Same as left | Same as left |
| | Apparent Zn amount | 37.00 | 36.45 | 37.45 | 37.45 | 36.20 | 37.20 | 38.60 | 38.40 | 35.00 |
| Hot extrusion | Extrusion temperature (°C) | 660 | 700 | 650 | 650 | 700 | 660 | 660 | 650 | 780 |
| | Phase ratio (%) α/β/γ | 80/20/0 | 78/22/0 | 77/23/0 | 77/23/0 | 80/20/0 | 77/23/0 | 68/32/0 | 65/35/0 | 79/21/0 |

Fig. 13 (b)

| | | Example 5 | Example 6 | Example 7 | Example 8 | Example 9 | Example 10 | Example 11 | Example 12 | Comparative example 1 (C2700) |
|---|---|---|---|---|---|---|---|---|---|---|
| Before cold drawing | Intermediate annealing [α phase-making annealing] temperature (°C) | 500 | 500 | 500 | 500 | 500 | 500 | 500 | 500 | 600.00 |
| | Cooling rate after annealing (°C/sec) | 0.30 | 0.30 | 0.30 | 0.30 | 0.30 | 0.30 | 0.30 | 0.30 | 0.30 |
| | Phase ratio (%) α/β/γ | 100/0/0 | 100/0/0 | 99/0/1 | 99/0/1 | 99/0/1 | 98/0/2 | 96/0/5 | 97/0/4 | 100/0/0 |
| | Crystal grain size (μm) | 45 | 45 | 40 | 40 | 40 | 40 | 38 | 38 | 45 |
| | Polishability*1 | × | × | × | × | × | × | △ | △ | × |
| | Machinability *2 | × | × | × | × | × | × | ○ | × | × |
| | Corrosion resistance *3 | × | ○ | ○ | ○ | ○ | ○ | ○ | ○ | × |
| | Bending property *4 | △ | △ | △ | △ | △ | △ | △ | △ | △ |
| | SCC resistance *5 | × | × | × | × | × | × | △ | △ | × |
| | Strength *6 | × | ○ | ○ | ○ | ○ | ○ | ○ | ○ | × |
| | Elongation *7 | ○ | ○ | ○ | ○ | ○ | ○ | ○ | ○ | ○ |
| | Hardness *8 | × | × | × | × | × | × | × | × | × |
| | Erosion corrosion *9 | × | × | × | × | × | × | △ | △ | × |

Fig. 13 (c)

| | | Example 5 | Example 6 | Example 7 | Example 8 | Example 9 | Example 10 | Example 11 | Example 12 | Comparative example 1 (C2700) |
|---|---|---|---|---|---|---|---|---|---|---|
| Final pipe material | Final annealing temperature (°C) | 600 | 610 | 605 | 450 | 640 | 650 | 435 | 650 | 600 |
| | Cooling rate after annealing (°C/sec) | 300 or higher | 300 or higher | 300 or higher | 1.0 | 300 or higher | 300 or higher | 0.3 | 5.0 | 0.3 |
| | Phase ratio (%) α/β/γ | 90/10/0 | 90/10/0 | 86/14/0 | 97/0/3 | 82/18/0 | 77/23/0 | 90/0/10 | 83/14/3 | 100/0/0 |
| | Crystal grain size (μm) | 20 | 19 | 17 | 14 | 17 | 16 | 13 | 20 | 30 |
| | Sn concentration in each phase (%) α/β/γ | 0/0/– | 0.7/2.2/– | 0.8/2.6/– | 0.8/–/9.1 | 0.8/2.5/– | 0.8/3.1/– | 0.8/–/8.8 | 0.9/2.1/12.0 | 0/–/– |
| | Polishability *1 | ○ | ○ | ○ | ○ | ○ | ○ | ○ | ○ | × |
| | Machinability *2 | ○ | ○ | ○ | ○ | ○ | ○ | ○ | ○ | × |
| | Corrosion resistance *3 | × | ○ | ○ | ○ | ○ | ○ | ○ | ○ | × |
| | Bending property *4 | ○ | ○ | ○ | ○ | ○ | ○ | ○ | ○ | □ |
| | SCC resistance *5 | × | ○ | ○ | ○ | ○ | ○ | ○ | ○ | × |
| | Strength *6 | × | ○ | ○ | ○ | ○ | ○ | ○ | ○ | × |
| | Elongation *7 | ○ | ○ | ○ | ○ | ○ | ○ | ○ | ○ | ○ |
| | Hardness *8 | × | ○ | ○ | ○ | ○ | ○ | ○ | ○ | × |
| | Erosion corrosion *9 | × | ○ | ○ | ○ | ○ | ○ | ○ | ○ | × |

Fig. 14

By an automatic polishing device (Viewler ECOMET IV) for a sample, evaluation was carried out according to the finishing rate of the surface when polishing was carried out under the same conditions.

<#600 Polishing>
Polishing plate
rotation number : 150 rpm
Sample pressing pressure: 6.9 KPa
Polishing paper : #600
Sample initial surface: #80 finishing <Buffing>
Polishing plate
rotation number : 200 rpm
Sample pressing pressure: 6.9 KPa
Polishing powder : $Al_2O_3$ 0.3 μm
Sample initial surface: #600 finishing Finishing time by polishing

| | Example 8 | Comparative example 1 |
|---|---|---|
| #600 Polishing | 30 seconds | 1 minute |
| Buffing | 2 minutes | 4 minutes |

Fig. 15

| | Example 7 | | Example 8 | | Comparative example 1 (C2700) | | Comparative example 2 (conventional dezinking resistant brass pipe) | |
|---|---|---|---|---|---|---|---|---|
| | Straight portion | Bent portion | Straight portion | Bent portion | Straight portion | Bent portion | Straight portion | Bent portion |
| Final annealing temperature (°C) | 605 | 605 | 450 | 450 | 600 | 600 | 600 | 600 |
| Phase ratio (%) [α/β/γ] | 86/14/0 | 86/14/0 | 97/0/3 | 97/0/3 | 100/0/0 | 100/0/0 | 100/0/0 | 100/0/0 |
| | | | | | | | | |
| Dezinking corrosion (μm) | 25 | 62 | 5 | 60 | 140 | 195 | 100 | 130 |
| | | | | | | | | |

*Evaluation was carried out by the dezinking corrosion test according to Japanese Brass Makers Association Technical Standard (JBMA T-303)

BRASS MATERIAL, BRASS TUBE AND THEIR PRODUCTION METHOD

This application is a U.S. national phase application of International application PCT/JP98/04786 filed Oct. 22, 1998.

TECHNICAL FIELD

This invention relates to a brass material and a method of manufacturing the same, mainly relates to a brass pipe material and a method of manufacturing brass.

BACKGROUND ART

Previously, a brass pipe material generally comprises a single α phase material. This is a result of reducing a β phase ratio which inhibits cold ductility , providing for cold draw out (drawing) or cold bending fabrication.

However, a brass pipe material of a single α phase does not utilize a β phase excellent in machinability and polishability so that it has problems of inferior in machinability and polishability.

Also, the conventional brass pipe materials were made crystal grain diameter relatively large similarly to ensure cold ductility so that they have problems of inferior in corrosion resistance and strength.

An object of the present invention is to improve machinability and polishability in a brass material prepared through a cold working, particularly in a brass pipe material.

DISCLOSURE OF THE INVENTION

In the process of a brass material according to the present invention, a brass material excellent in machinability and polishability can be provided by increasing an area ratio of a crystal phase other than an α-phase after extrusion or rolling.

As a suitable embodiment, when a composition comprises an apparent Zn content of 33.5 to 43% by wt., by heating to 550 to 800° C., and when an apparent Zn content is 38.5 to 43% by wt., by heating to a temperature region of 550 to 800° C., or 400 to 500° C., the area ratio of a β phase can be increased, preferably the area ratio of a β phase can be made 5% or more.

Here, the term "an apparent Zn content" is used in the meaning of "$\{(B+t\cdot Q)/(A+B+t\cdot Q)\}\times 100$" wherein A is a Cu content [% by wt.], B is a Zn content [% by wt.], t is a Zn equivalent of the third element (e.g., Sn), and Q is a content of the third element [% by wt.].

For preventing decrease of the P phase once increased during cooling, when the temperature region to be heated is 550 to 800° C., it is rapidly cooled at a cooling rate of 5° C./sec or higher until 400° C., and when the temperature region to be heated is 400 to 500° C., it is rapidly cooled at a cooling rate of 1° C./sec or higher until 400° C.

As the other suitable embodiment, when an apparent Zn content is 33.5 to 43% by wt. and Sn content is 0.5 to 2.0% by wt., by heating to a temperature region of 400 to 500° C., an area ratio of a γ phase can be increased, preferably the area ratio of the γ phase can be made 1% or more.

Here, when the temperature region of 400 to 500° C. is maintained for one hour or more, the γ phase becomes spherical so that strength or machinability and polishability are more improved. Also, for preventing decrease of the γ phase once increased during cooling, it is preferably rapidly cooled at a cooling rate of 1° C./sec or higher until 400° C.

Incidentally, when an apparent Zn content is 33.5 to 43% by wt. and Sn content is 0.5 to 1.3% by wt., a cold working is easy since the Sn amount is relatively low, and in the case of the composition where an apparent Zn content is 33.5 to 43% by wt. and Sn content is 1.3 to 2.0% by wt., a γ phase can be easily precipitated since the Sn amount is relatively large.

As the suitable embodiment in the present invention as mentioned above, a cold working such as bending processing or drawing processing of a pipe material can be carried out before a heat treatment step.

In this case, it is preferred that before the cold working, a heat treatment step for making an α phase to increase the area ratio of the α phase whereby cold ductility is previously secured. This heat treatment step for making an α phase is to maintain, for example, at 450 to 550° C. for 10 minutes or longer when an apparent Zn content is 33.5 to 43% by wt. If a crystal grain size is coarsened during the heat treatment step for making an a phase, it can contribute to improve ductility at the time of the cold working.

And according to such a heat treatment step for making an α phase, before the cold working, the area ratio of the α phase can be made 90% or higher, preferably 95% or higher, or elongation in cold can be made 20% or higher, preferably 35% or higher.

Incidentally, after the cold working, an annealing step for controlling an internal stress is usually carried out. The timing of effecting the annealing step may be before or after the heat treatment step.

Also, in the method of production the brass material according to the present invention, by having a crystal grain size fining treatment during the heat treatment or in a step before the heat treatment, surface roughening at a bending processing can be reduced while further improving polishability by making the average crystal grain size of 50 μm or smaller, preferably 25 μm or smaller.

Such a crystal grain size fining treatment is desirably carried out after the cold working. That is, before the cold working, the crystal grain size is made relatively larger to ensure cold ductility, but when the crystal grain size is remained in a larger size after the cold working, polishability, corrosion resistance and strength become poor. Thus, by going through the crystal grain size fining treatment after the cold working, the crystal grain size can be certainly made small whereby the polishability, etc. are improved.

As a suitable embodiment, the crystal grain size fining treatment can be carried out by recrystallizing transformation introduced by the cold working under heating. In this case, it is desired to make a transformation density as high as possible at the cold working and a sectional area reduction ratio of 20% or more is preferred.

Also, in order to prevent the crystal grain size coarsen again, it is desired to set an upper limit in a heating time or to rapidly cooled after heating. For example, in a heat treatment heating to 550 to 800° C., coarsening again of the crystal particle size can be prevented by making an upper limit of a heatingmaintaining time within 30 minutes.

As a suitable embodiment of the cold working in the present invention as mentioned above, when the cold working and annealing are carried out repeatedly, it is desired that an area reducing ratio at the final cold working is made large, and a temperature at the final annealing is made lower than the annealing during the procedure. For example, when the annealing temperature during the procedure is 500 to 600° C., the annealing temperature at the final is desirably 500° C. or lower.

Also, as a use of a process for producing a brass material according to the present invention, it is desirably applied to a method for producing a brass pipe material. This is because a pipe material is subjected to cold drawing and bending processing in many cases.

Subsequently, the brass material according to the present invention comprises satisfying at least one of (1) a machining resistance index based on, as the reference, the free-cutting brass bar conforming to JIS (Japanese Industrial Standard) C 3604 is 50 or higher,preferably 80 or higher, (2) through dezinking test conducted in accordance with the technical standard T-303 of JBMA (Japan Brass Makers Association ),corrosion resistance was confirmed as fellows: If the direction of maximum dezinking penetration depth is parallel with the working direction, the maximum dezinking penetration depth is not deeper than 100 $\mu$m, and if the direction of the maximum dezinking penetration depth is rectangular to the working direction, the maximum dezinking penetration depth is not deeper than 70 $\mu$m.

As a suitable embodiment of such a brass material, there is a pipe material, and it can be applied not only to the pipe material prepared by casting and extrusion after casting, but also to the pipe material (seam welded pipe, etc.) prepared by a plate material being subjected to bending fabrication, and then jointing the edge portion.

Incidentally, when this producing method is used, excellent characteristics can be shown with regard to the polishability in addition to the characteristics other than the mentioned above. That is, as for the polishability, it is evaluated in the view points that 1. when polishing is carried out in the same conditions, surface roughness after polishing is small as compared with the conventional material, 2. when polishing is carried out in the same conditions, a polishing amount is large as compared with the conventional material, and 3. when polishing is carried out in the same conditions, there is no defect in appearance and coverage of plating is good as compared with the conventional material. As a result of evaluation from these view points, the brass pipe material according to the present invention is shown to be excellent as compared with the conventional brass pipe material.

When the polishability is quantitated, in the pipe material according to the present invention, after the heat treatment, when a flaw of #80 is surface polished under the conditions of the polishing device of Viewler ECOMET IV, a polishing plate rotation number of 200 rpm, a sample pressing pressure of 6.9 KPa and a polishing paper of SiC #600, it has a characteristic of finishing the polishing within a time of ½ as compared with the brass pipe material according to Japanese Industrial Standard JIS C-2700.

Also, the pipe material according to the present invention, in the pipe material according to the present invention, after the heat treatment, when a flaw of #600 is surface polished under the conditions of the polishing device of Viewler ECOMET IV, a polishing plate rotation number of 150 rpm, a sample pressing pressure of 6.9 KPa and polishing powder of $Al_2O_3$, it has a characteristic of finishing the polishing within a time of ½ as compared with the brass pipe material according to Japanese Industrial Standard JIS C-2700.

As others, the pipe material according to the present invention has Sn as a starting composition and subjected to bending processing, and the portion in which the bending processing is carried out satisfies the maximum dezinking penetration depth of 70 $\mu$m or less when the dezinking corrosion test is carried out according to Japanese Copper-Distend Association Technical Standard JBMA T-303 after the heat treatment.

Subsequently, the brass material produced by a cold working according to the present invention has a first phase comprising an $\alpha$ phase, and a second phase different from the first phase, and the area ratio of the first phase is 99% or less so that the machinability and polishability are improved as compared with the brass material prepared through the conventional cold working of an single $\alpha$ phase.

As a suitable embodiment, by making the area ratio of a $\beta$ phase 5% or more, the machinability, etc. are to be ensured by effectively utilizing the $\beta$ phase inherently excellent in the machinability and polishability. Moreover, by making the area ratio of the $\beta$ phase 40% or less, preferably 20% or less, corrosion resistance can be ensured.

Further suitably, when an Sn concentration in the $\beta$ phase is made 1.5% by wt. or more, improvement in corrosion resistance can be effected as a whole by strengthening the $\beta$ phase which is inherently inferior in corrosion resistance.

Also, by making the average crystal grain size 50 $\mu$m or smaller, preferably 25 $\mu$m or smaller, not only inhibition of surface roughness at the bent portion and improvement in the polishability but also improvement in corrosion resistance and strength can be effected.

As the other suitable embodiment, by making the area ratio of a $\gamma$ phase 1% or more, strength is to be improved by utilizing strength possessed by the $\gamma$ phase while ensuring machinability, etc. by effectively utilizing the machinability and polishability at the intersurface between the hard $\gamma$ phase and the other phase. Suitably, by making the area ratio of the $\gamma$ phase 30% or less, brittleness possessed by the $\gamma$ phase is reduced.

More suitably, when the average crystal grain size (short diameter) of the $\gamma$ phase is made 8 $\mu$m or smaller, preferably 5 $\mu$m or smaller, brittleness possessed by the $\gamma$ phase is more reduced, but when an Sn concentration of the $\gamma$ phase is 8% by wt. or more, corrosion resistance is also improved. Particularly when the $\beta$ phase is contained, by surrounding the $\beta$ phase by the $\gamma$ phase with the Sn concentration of 8% by wt. or more, improvement in corrosion resistance can be effected as a whole by protecting the $\beta$ phase which is inherently inferior in corrosion resistance.

The brass pipe material according to the present invention (including a raw tube which is not subjected to cold drawing) has the respective characteristic features of (1) the area ratio of the $\gamma$-phase is 1% or more, (2) it has a first phase comprising an $\alpha$-phase and a second phase different from the first phase, and the area ratio of the first phase is 99% or less and the average crystal grain size (short axis) of the above-mentioned second phase is 8 $\mu$m or smaller, (3) it has a first phase comprising an $\alpha$ phase and a second phase different from the first phase, and the area ratio of the first phase is 95% or less and the average crystal grain size of 50 $\mu$m or smaller, preferably 25 $\mu$m or smaller, (4) the average crystal grain size is 25 $\mu$m or smaller, the $\alpha$ phase is 25 $\mu$m or smaller, the $\beta$ phase is 20 $\mu$m or smaller and the $\gamma$ phase is 8 $\mu$m or smaller.

Similarly, the brass pipe material according to the present invention has the respective characteristic features of (1) machining resistance index based on , as the reference, the free-cutting brass bar conforming to JIS (Japanese Industrial Standard) C3604 is 50 or higher, preferably 80 or more, (2) when a flaw of #80 is surface polished under the conditions of the polishing device of Viewler ECOMET IV, a polishing plate rotation number of 200 rpm, a sample pressing pressure of 6.9 KPa and a polishing paper of SiC #600, it has a characteristic of finishing the polishing within a time of ½ as compared with the brass pipe material according to Japanese Industrial Standard JIS C-2700, (3) when a flaw of #600 is surface polished under the conditions of the polishing device of Viewler ECOMET IV, a polishing plate rotation number of 150 rpm, a sample pressing pressure of 6.9 KPa and polishing powder of $Al_2O_3$, it has a characteristic of finishing the polishing within a time of ½ as compared with the brass pipe material according to Japanese Industrial Standard JIS C-2700.

Subsequently, the brass pipe material according to the present invention has characteristic feature in that an apparent Zn content is 33.5 to 43.0% by wt. and Sn content is 0.5 to 1.3% by wt., or an apparent Zn content is 33.5 to 43.0% by wt. and Sn content is 1.3 to 2% by wt. As the other components, as for a Pb content, if it is too much, a cold ductility is lowered so that it is preferably 0.07% by wt. or less.

That is, if the apparent Zn content is too large, it is difficult to enlarge an α phase ratio at the time of cold working, and a γ phase which inhibits the cold ductility at the annealing process for making the α phase is likely precipitated. While if the apparent Zn content is too small, it is difficult to enlarge a β and γ phase ratio after the cold working so that it is made in the above range. According to this range, during the cold working, while ensuring the cold ductility, and after the cold working, the machinability and the polishability can be ensured.

Incidentally, in the former, an Sn amount is relatively small so that the cold working is easy, and in the latter, the Sn amount is relatively large so that the β and γ phase can be easily precipitated.

In the brass pipe material according to the present invention as mentioned above, an apparent Zn amount is high as compared with the conventional brass pipe material so that at the time of hot extrusion, a ratio of the soft β phase is high and extrusion resistance becomes low whereby the extrusion property is excellent.

That is, if the extrusion is carried out at the same temperature region as the conventional brass pipe material, extrusion with an sectional area reducing ratio higher than the conventional one can be carried out and by subjecting to extrusion to the shape near to the final pipe shape, a load at the cold drawing thereafter can be reduced.

On the other hand, if the extrusion is carried out with an sectional area reducing ratio as the conventional one, extrusion at a temperature lower than the conventional one can be carried out so that a load for a billet heating can be reduced.

Here, after hot extrusion, it is desired to cool down as soon as possible. That is, Sn is added so that if a cooling rate after extrusion is slow, a γ phase is precipitated with a large amount so that the latter heat treatment step for making an α phase takes a long time. Thus, when precipitation of the γ phase is prevented by cooling as soon as possible and α+β structure is made, a time necessary for the heat treatment step for making an α phase can be shortened.

BRIEF DESCRIPTION OF THE DRAWINGS

FIG. 11 is a list of a starting material composition, crystal structure and physical properties in the embodiment.

FIGS. 13(*a*), 13(*b*), and 13(*c*) are lists of other examples of starting material compositions, crystal structures and physical properties in the embodiment.

FIG. 14 is evaluation results of a polishability in the embodiment.

FIG. 15 is evaluation results of corrosion resistance after a bending in the embodiment.

EMBODIMENTS OF THE INVENTION

Figure 1A:
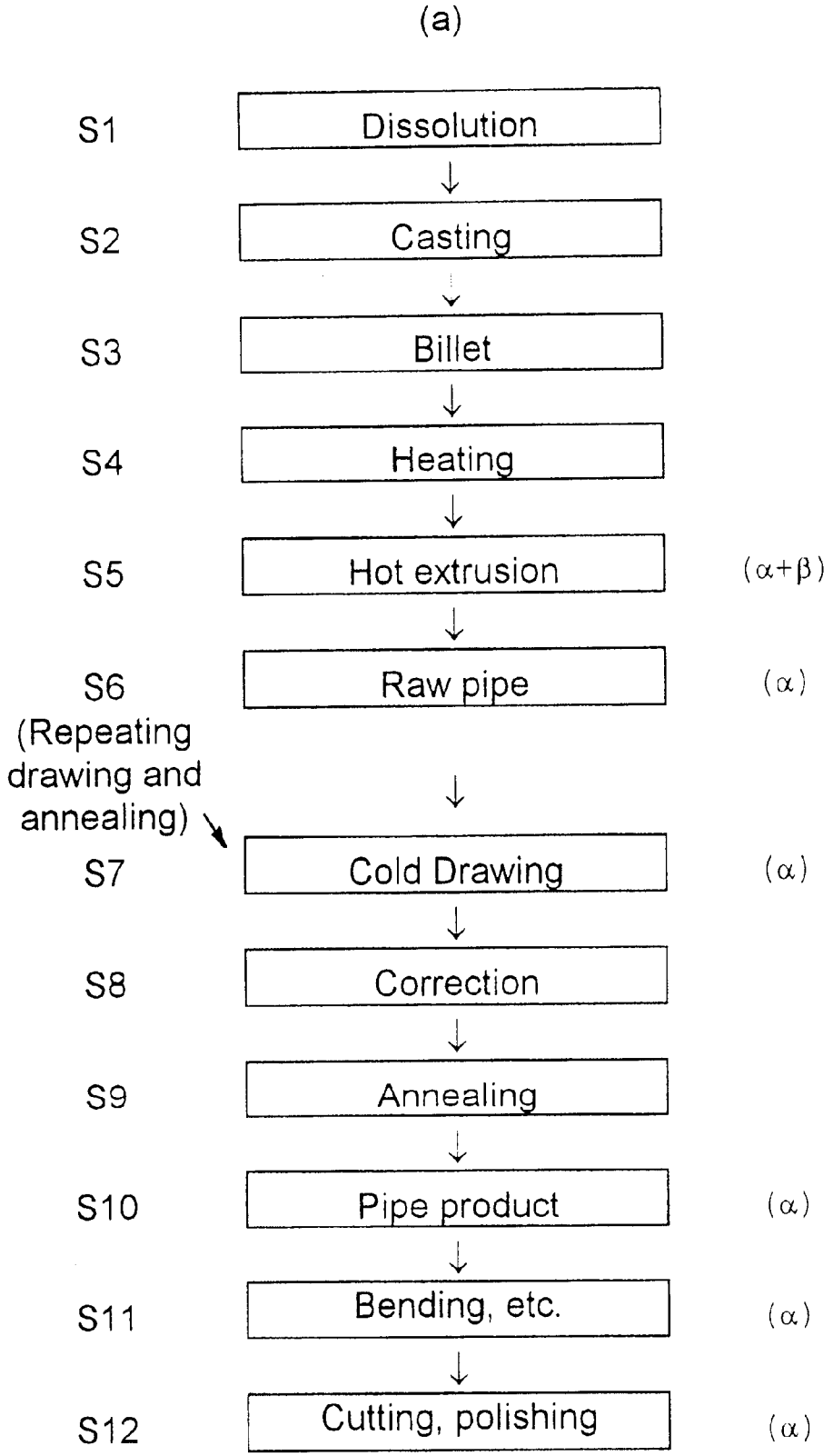
FIGS. 1(*a*), 1(*b*), and 1(*c*) are production step flow charts of the conventional brass pipe material and a production step flow chart of a brass pipe material which is an embodiment of the present invention.
Figure 1B:
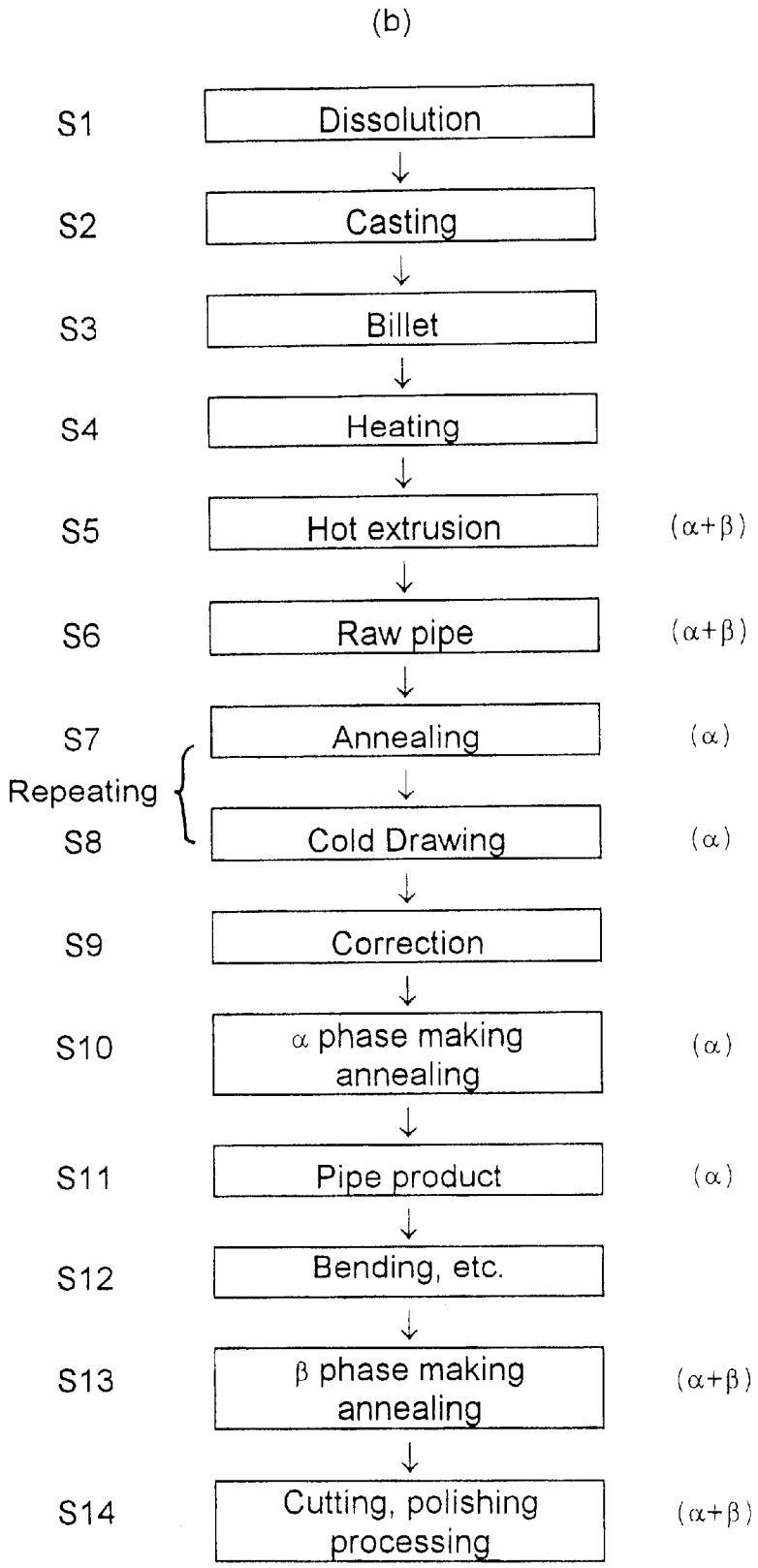
Figure 1C:
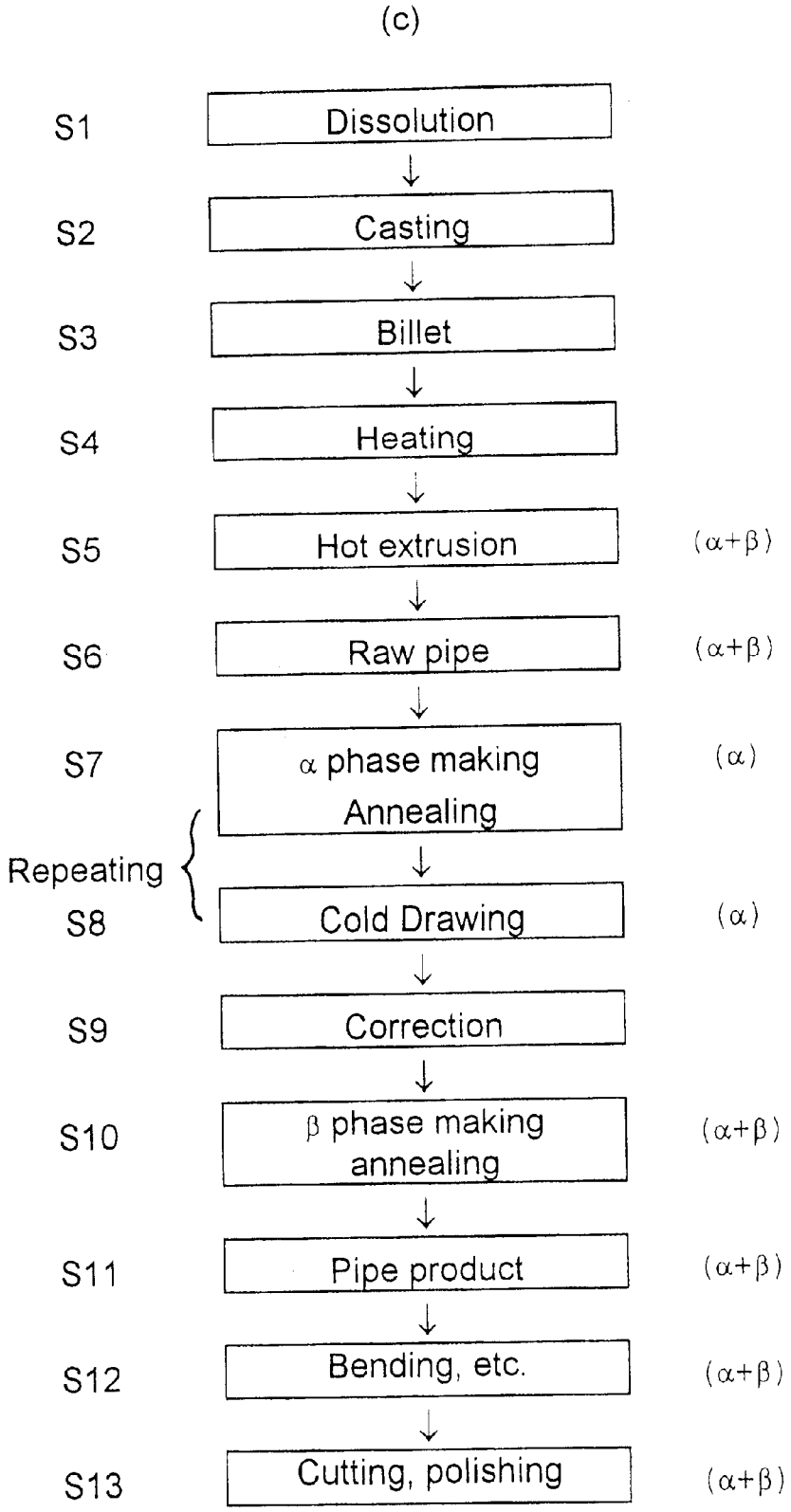

In the following, an embodiment of the present invention is described in detail. FIG. 1 shows a production step [conventional example] (a) of the conventional brass pipe material and production steps [Examples] (b) and (c) of the brass pipe material of the embodiment of the present invention.

In the conventional example (a), a brass starting material is first dissolved (Step 1), and then a continuous casting is carried out (Step 2) to form a billet (Step 3).

And after heating to a recrystallization temperature region (Step 4), hot extrusion forming is applied to adjust crystal arrangement and to remove brittleness of a cast structure (Step 5), to form a raw pipe (Step 6).

Subsequently, cold drawing is carried out to obtain a predetermined dimension (Step 7), and after correcting the shape of the tube (Step 8), annealing is carried out to remove internal stress or for tempering (Step 9), and applied to cutting, etc. to produce a pipe product (Step 10). In the actual production steps, Steps 7 to 9 are repeated in many cases.

Such a pipe product is subjected to bending, etc. (Step 11), then subjected to machining and polishing processing (Step 12) to prepare a final product.

The raw pipe of Step 6 in the above producing step is required to have cold ductility as a pipe material at the cold drawing of Step 7 so that it became a single phase of an α phase which is most excellent in cold ductility among the crystal phases.

Accompanying with this, in Step 1, a brass starting material having a less apparent Zn equivalent is used to easily change to the α phase in Steps 6 and 7. In Step 12, machining and polishing were carried out in the state of the α phase so that there is a problem that it is inferior in machinability and polishablity. (since the α phase is inferior in machinability and polishability among the crystal phases.)

Subsequently, Example (b) is explained. First, in Step 1, a starting material having a higher apparent Zn equivalent than the conventional one is dissolved to easily obtain a β phase. (An apparent Zn content is suitably 33.5 to 43.0% by wt.)

Steps 2 to 6 subsequent thereto are carried out with the same steps as the conventional example, but the Zn equivalent is made high in Step 1 so that the raw pipe in Step 6 comprises an α+β mixed phase. Here, when cold drawing is carried out in the same manner as in the conventional example, a problem occurs that it is inferior in cold ductility as compared with the conventional example and an area reducing ratio at the cold drawing cannot be large so that a number of steps for drawing increases.

Thus, in Example (b), as Step 7, an α phase making annealing treatment to make the α+β mixed phase substantially α phase is to be carried out. When the α phase making annealing treatment is explained in detail by referring to FIG. 4, the treatment is carried out by heating the material to 550° C. in 15 minutes, then maintaining 550° C. for 20 minutes, and cooling to normal temperature in 15 minutes. The heating time of the α phase making annealing treatment is optionally changed depending on the composition or a heating temperature. FIG. 5 is a modified example.

Here, when the crystal grain size becomes fine by hot extrusion of Step 5, it is desired to coarsen the crystal grain size at the time of α phase making annealing. This is because for making cold ductility large by the cold working of Step 8, not only making the area ratio of the aphase but also enlarging the crystal grain size contribute.

Figure 2D:
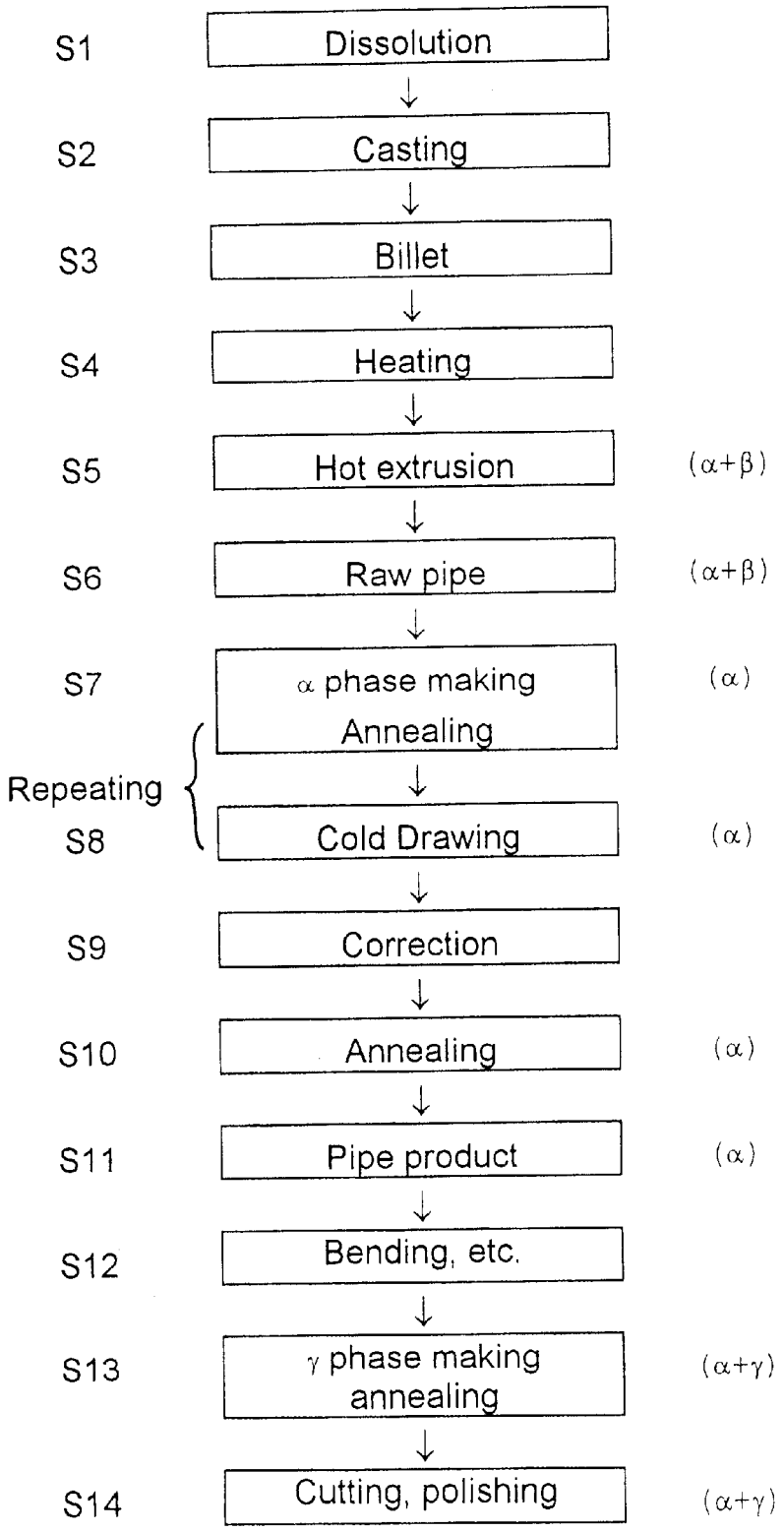
FIGS. 2(*d*) and 2(*e*) are modified examples of a production step flow chart of a brass pipe material in the embodiment.
Figure 2E:
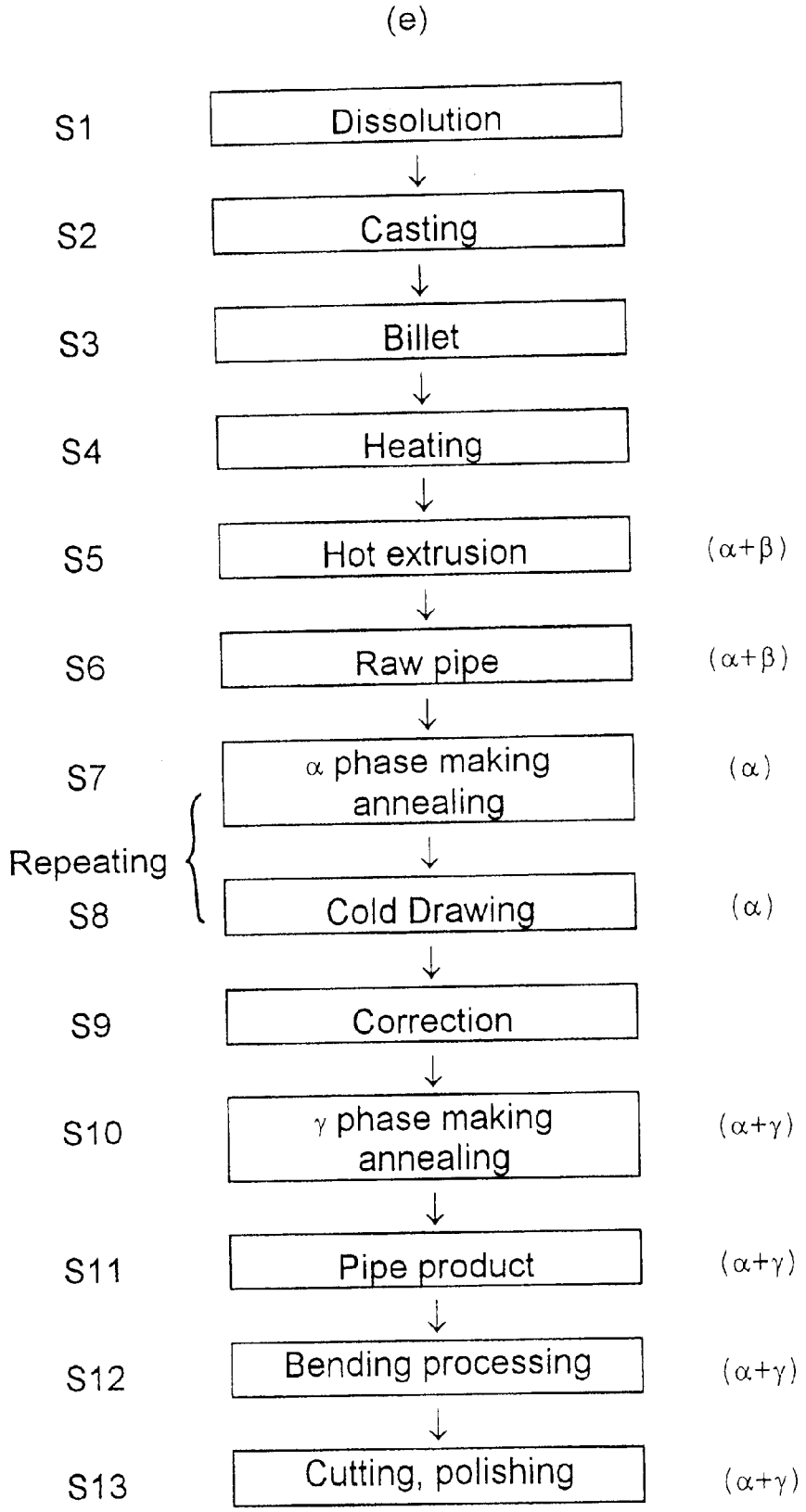
Figure 4:
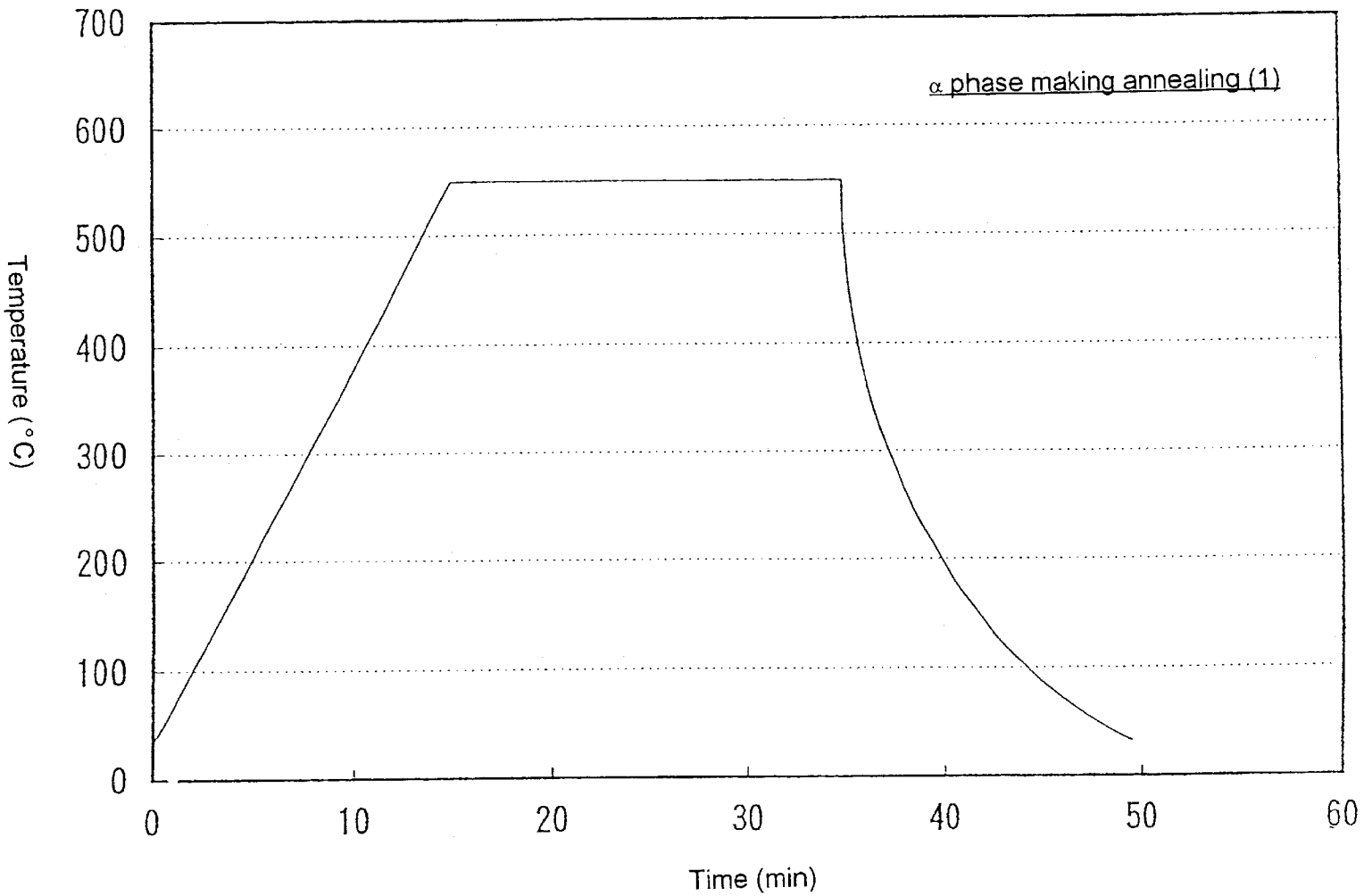
FIG. 4 is a temperature controlling drawing showing an α phase making annealing treatment in the embodiment.
Figure 5:
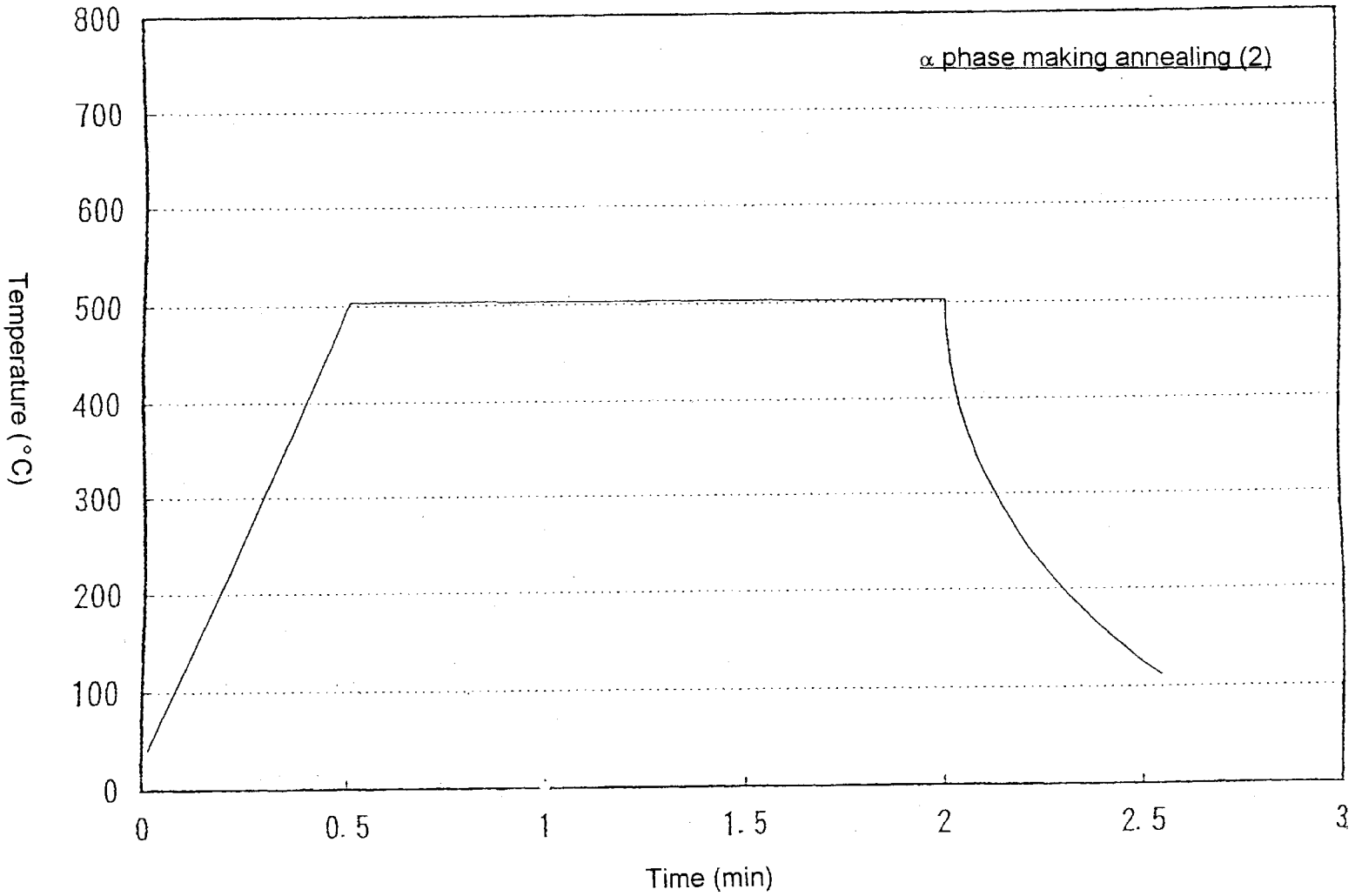
FIG. 5 is a temperature controlling drawing showing other example of an α phase making annealing treatment in the embodiment.
Figure 6:
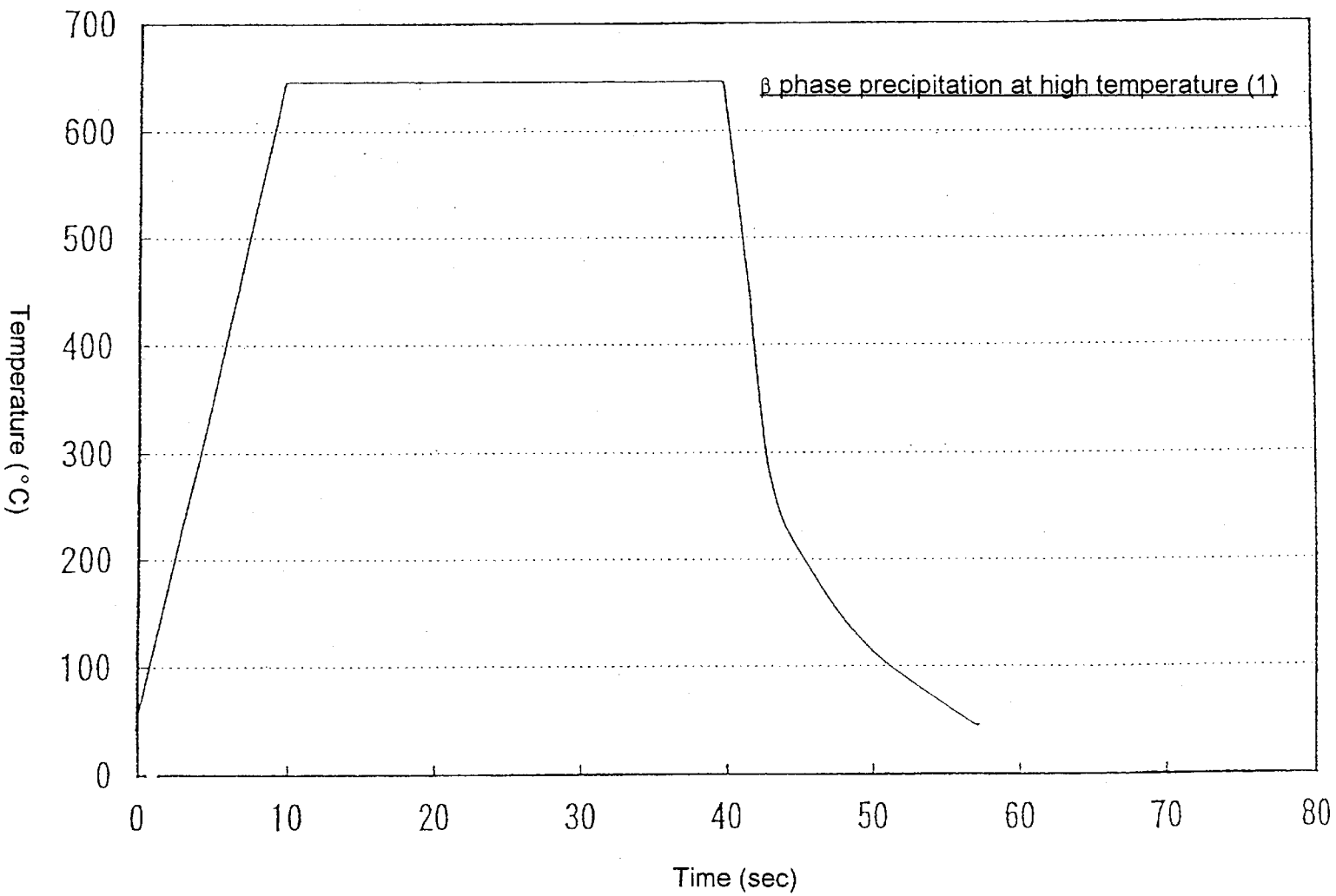
FIG. 6 is a temperature controlling drawing showing a β phase making annealing treatment (example of a high temperature region) in the embodiment.

In the example of FIG. 4, as a result of applying the treatment of FIG. 2 to a raw pipe having an average crystal grain size of 15 μm or less with an α+β mixed phase, an single α phase pipe material exceeding an average crystal grain diameter of 30 μm can be obtained, and increment in the α-phase area ratio but also coarsening of an average crystal grain size are realized. Incidentally, as for increment in the α phase area ratio and coarsening of an average crystal grain size, it may be carried out not by the one step as in FIG. 4 but by the separate steps.

Returning to FIG. 1(*b*), after such a Step 7, Steps 8 to 12 which are the same as the conventional example are carried out, but for effecting cold drawing of Step 8 and bending processing of Step 12, these treatments are carried out in the single α phase as in the conventional one so that substantially the same cold working property as the conventional example is obtained. Incidentally, when Steps 7 and 8 are repeated, a degree of forming at the final drawing is preferably made as large as possible.

Thereafter, in the conventional example, machining and polishing processings of Step 12 are carried out. In Example (b), before this step, a β phase making annealing treatment is inserted to make the single α phase an α+β mixed phase (Step 13). And after going through Step 13, by going forward to machining and polishing processing of Step 14, machinability and polishability inherently possessed by the β phase can be effectively utilized.

Here, the β phase making annealing treatment is explained in detail by referring to FIGS. 6 to 9. First, in FIG. 6, the treatment is carried out by heating the material to 650° C. in 10 seconds, then maintaining 650° C. for 30 seconds, and rapidly cooled down to normal temperature.

Figure 7:
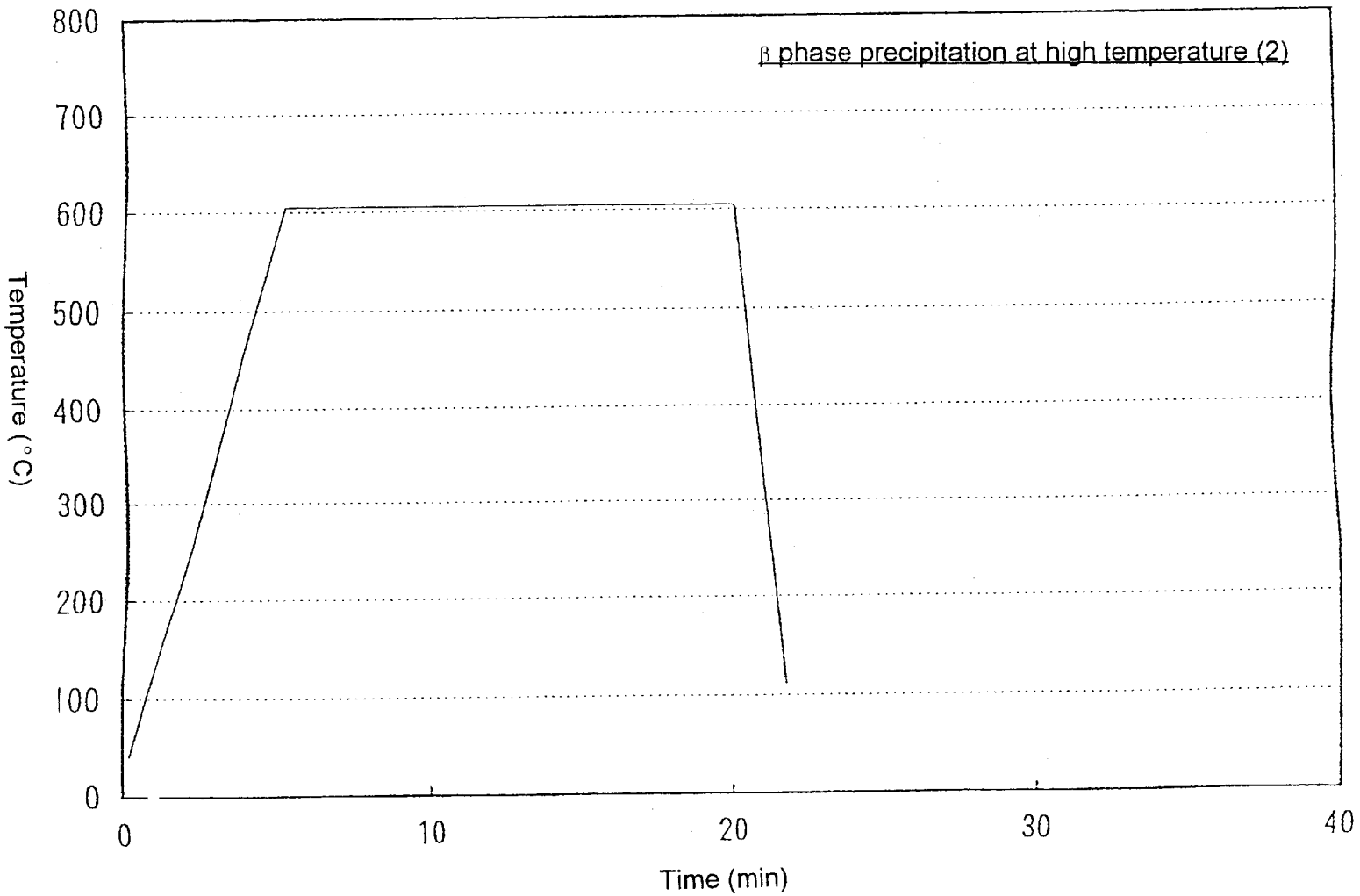
FIG. 7 is a temperature controlling drawing showing other example of a β phase making annealing treatment (example of a high temperature region) in the embodiment.

The heating time of the β phase making annealing treatment is preferably within 30 minutes. This is because when a high temperature state is maintained for a long period of time, coarsening of the crystal grain size occurs. Incidentally, the heating time of such a β phase making annealing treatment is optionally modified depending on the composition or heating temperature. FIG. 7 is a modified example.

Figure 8:
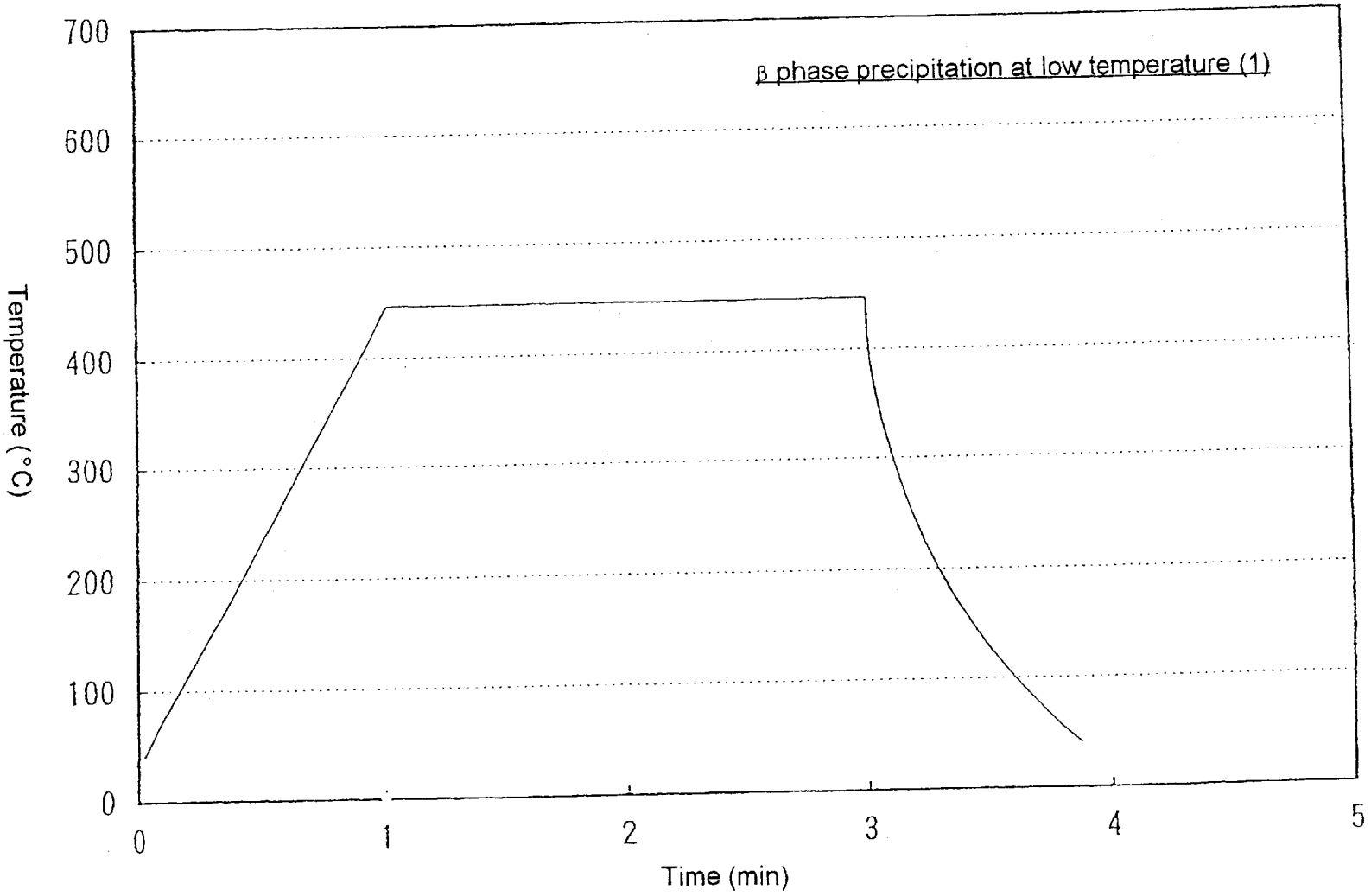
FIG. 8 is a temperature controlling drawing showing a β phase making annealing treatment (example of a low temperature region) in the embodiment.
Figure 9:
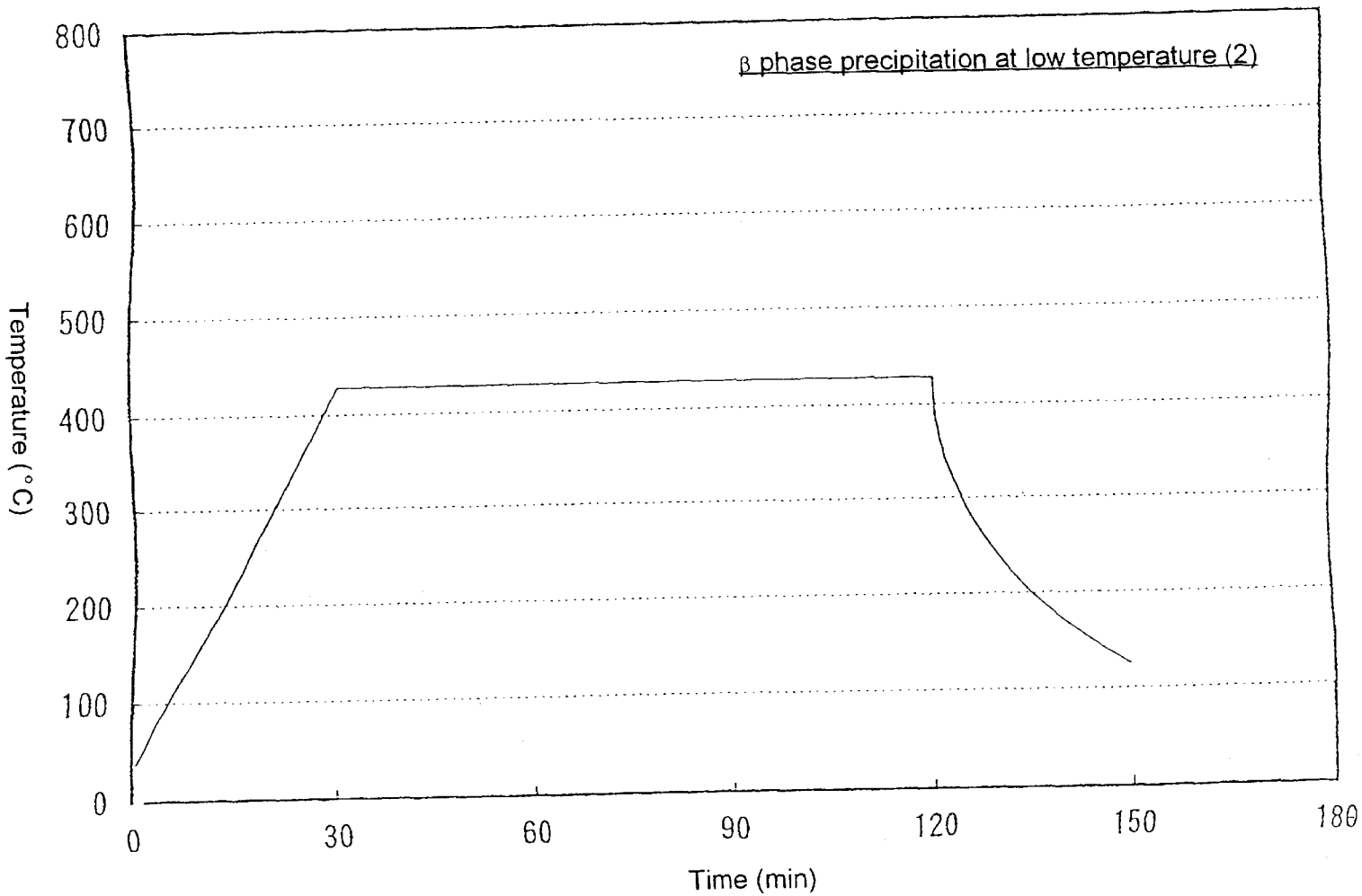
FIG. 9 is a temperature controlling drawing showing other example of a β phase making annealing treatment (example of a low temperature region) in the embodiment.

Next, in FIG. 8, the treatment is carried out by heating the material to 450° C. in 1 minute, then maintaining 450° C. for 2 minutes, and cooling to a normal temperature in 1 minute. In the example of the β phase making annealing, the heating temperature is a low temperature as compared with the examples of FIGS. 6 and 7 so that the crystal grain size is never coarsened even when it is maintained for a long period of time. The heating time of such a β phase making annealing treatment which prevents coarsening in the crystal grain size can be optionally modified depending on the composition or heating temperature. FIG. 9 is a modified example.

Further, in either of FIGS. 6 to 9, it is desired to rapidly cool down the material in the cooling procedure after heating. This is because if the material is cooled gradually, there are possibilities that an area ratio of the β phase which became a desired area ratio changes during the procedure or the crystal grain size becomes coarse. More specifically, in the cases of FIGS. 6 and 7, the cooling rate to 400° C. was made 5° C./sec or higher, and in the cases of FIGS. 8 and 9, the cooling rate to 400° C. was made 1° C./sec or higher.

When returned to FIG. 1, when Example (c) is explained subsequent to Example (b), in the procedure, it is different only the point that the annealing treatment of Step 10 and the β phase making annealing treatment of Step 13 in Example (b) are carried out in combination to make a β phase making annealing treatment of Step 10, the remaining procedures are the same as in Example (b).

When such two kinds of annealing treatments are carried out in combination, not only decreasing the number of procedures but also the following merits can be obtained. That is, before Step 11, a large sized pipe material is intended for, but after Step 11, a small sized pipe material after cutting the large-sized pipe material is intended for so that there is a problem that a design for equipments to effect annealing is difficult as compared with the large sized pipe material. Thus, the β phase making annealing treatment is applied to at the step of a large sized pipe material as in Example (c) so that such a problem can be solved.

Incidentally, in Example (c), there is anxious about lowering in workability since the material is the α+β mixed phase at the bending processing of Step 12 which is a cold working. However, as compared with the cold drawing, cold ductility is not required in the bending processing than the cold drawing among the cold working. Thus, it is enough to take care the β phase area ratio not to become too large.

In Examples (b) and (c) explained above, a fining treatment of the average crystal grain size is also carried out during the procedure. This is because, making the crystal grain size small, in addition to making the β phase area ratio large contribute to improve the polishability. More specifically, the last cold drawing of Step 7 is carried out with a large degree of forming, and at the time of annealing of Step 10 in Example (b) or at the time of β phase making annealing of Step 10 in Example (c), recrystallization takes place to make the crystal grain size fine.

In Examples (b) and (c) as mentioned above, the i phase making annealing treatment to increase the β phase area ratio is contained. As a modified example, it is useful to use a γ phase making annealing treatment to increase a γ phase area ratio in place of the β phase making annealing treatment. That is, the γ phase is inferior in cold ductility but is hard so that it has characteristics of improving mashinability and polishability due to the difference in hardness of crystals at the boundary of the a and β phases.

Incidentally, an embodiment relating to this γ phase making annealing treatment is as shown in FIG. 2, and examples in which the β phase making annealing of Examples (b) and (c) is replaced by the γ phase making annealing are Examples (d) and (e).

Figure 10:
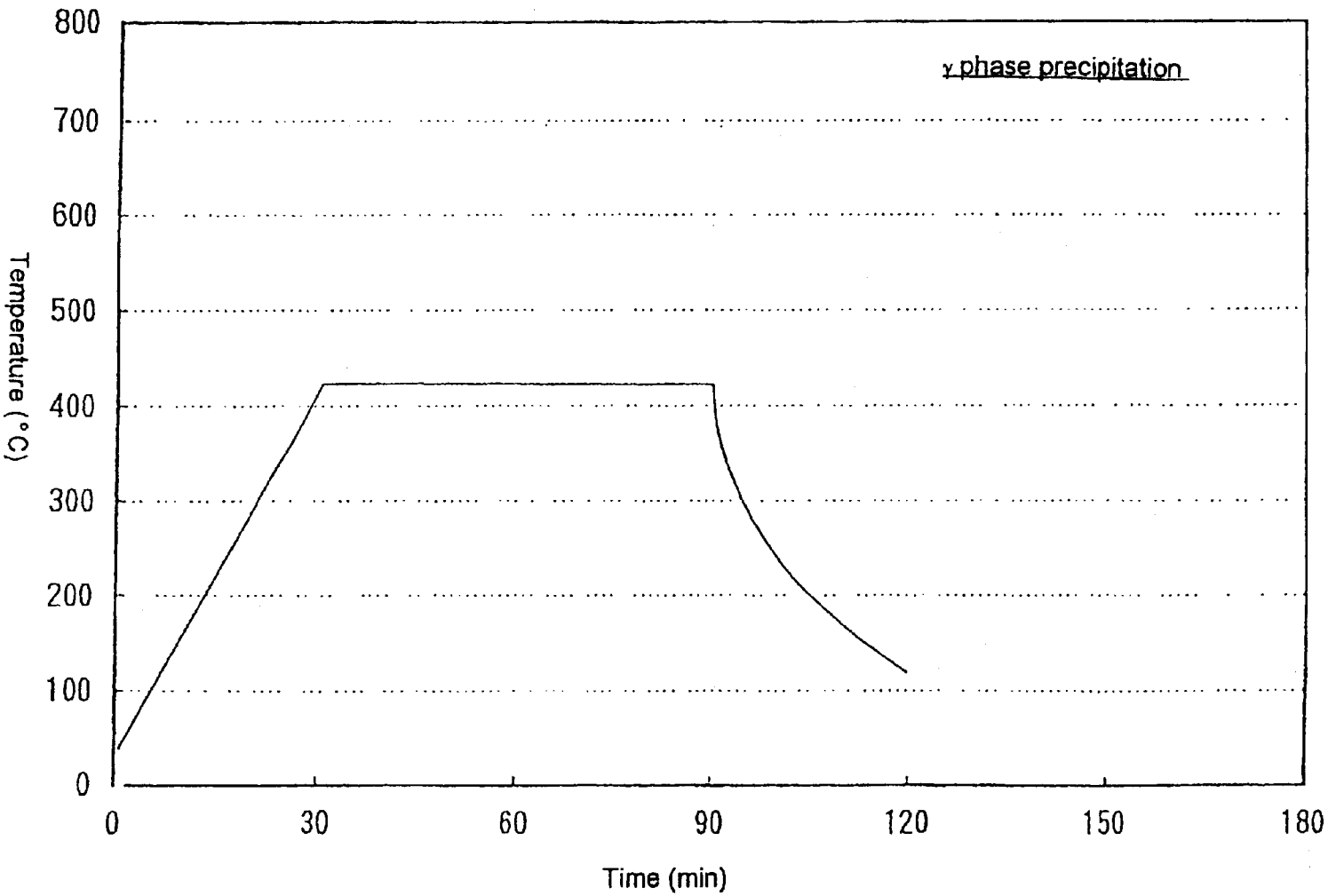
FIG. 10 is a temperature controlling drawing showing a γ phase making annealing treatment in the embodiment.

The γ phase making annealing treatment is explained in detail by referring to FIG. 10. In FIG. 10, the treatment is carried out by heating the material to 420° C. in 30 minutes, then maintaining 420° C. for 60 minutes and thereafter cooling to normal temperature. In the example of FIG. 10, the heating temperature is a low temperature so that the crystal grain size is never coarsened even when it is maintained for a long period of time or the cooling rate is slow.

Here, in Example (e), to the raw pipe of Step 6, cold drawing of Step 8 is carried out after subjecting to the α phase making annealing of Step 7. However, if an area ratio of the α phase is ensured with a certain extent at the step of the raw pipe, the α phase making annealing is not necessarily carried out before cold drawing.

Figure 3F:
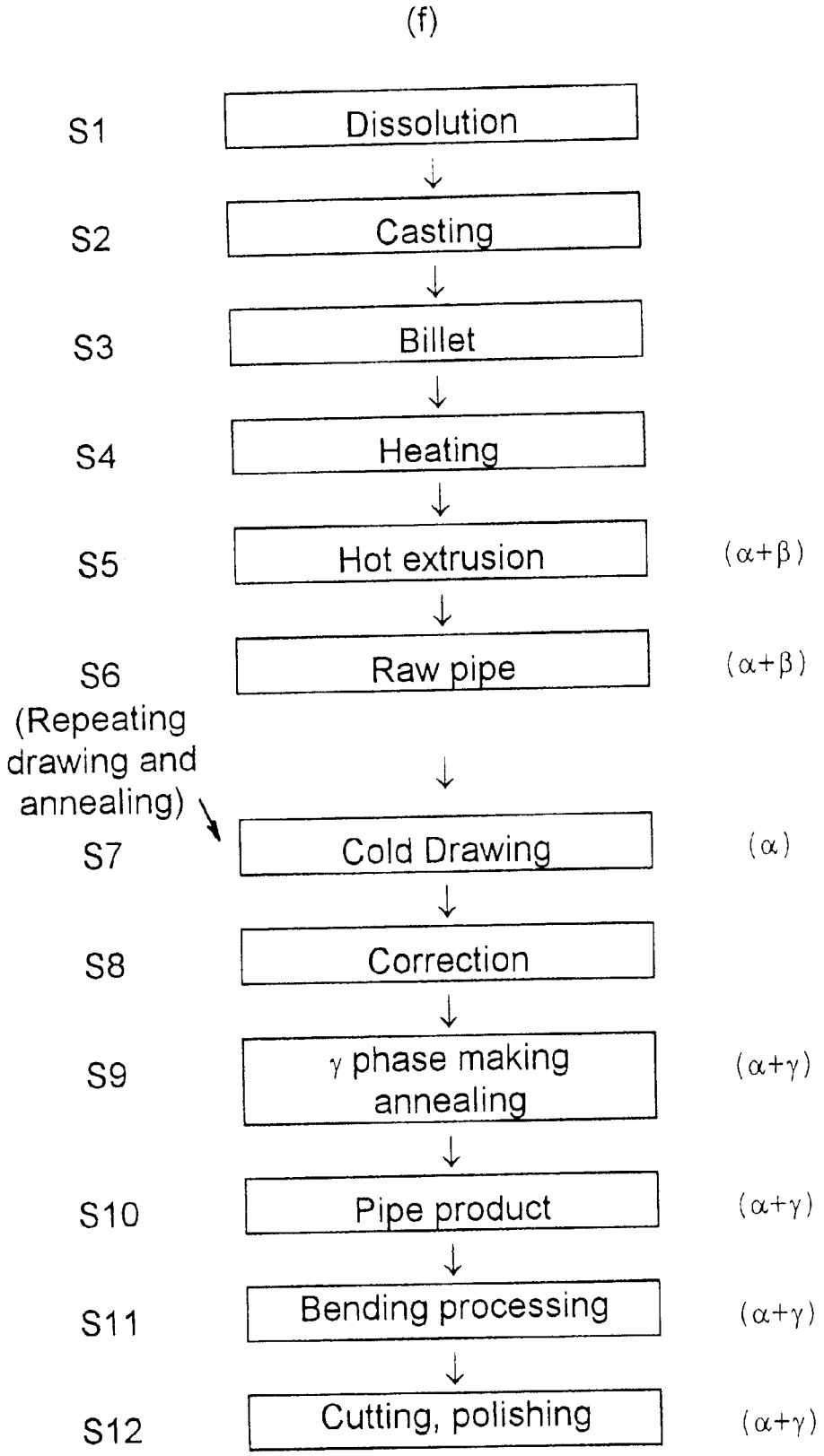
FIGS. 3(*f*) and 3(*g*) are further modified examples of a production step flow chart of a brass pipe material in the embodiment.
Figure 3G:
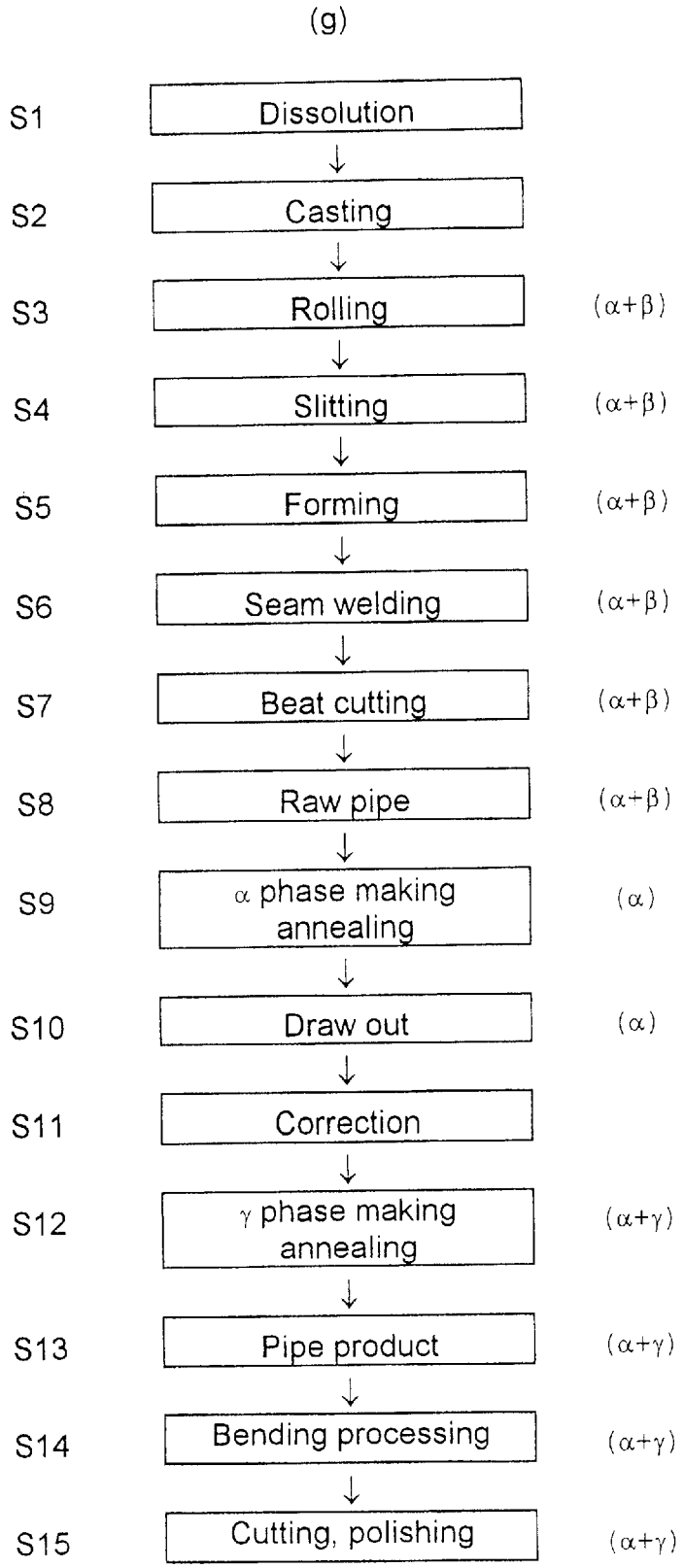

Example (f) of FIG. 3 shows the above. In Example (f), the α phase making annealing before cold drawing is omitted so that the number of steps can be reduced. Incidentally, it would be needless to say that to omit the α phase making annealing as mentioned above can be applied not only to the case where the γ phase making annealing is carried out as in Example (f) but also to the case where the β phase making annealing is carried out.

Examples (b) to (f) explained above areal related to a material in which it is formed to a tubular shape at the time of hot extrusion of Step 5, but the scope of the present invention to be applied to is not limited by these.

Example (g) in FIG. 3 shows a different embodiment from those of Examples (b) to (f), and it shows a process for producing a so-called seam welded pipe. In the case of Example (g), by inserting the γ phase making annealing (it may be the β phase making annealing) in Step 12, the same characteristics as in Examples (b) to (f) can be provided.

Also, in Examples (b) to (d) mentioned above, it is the primary object to combine ensuring cold ductility at cold working and ensuring machinability and polishability at machining and polishing. These contain a fining treatment of an average crystal grain size so that after the fining treatment, corrosion resistance can be also ensured.

When corrosion resistance is made a new point to be aimed at, it is possible to employ the following embodiment. That is, in Examples (b) to (d), there is anxious about corrosion resistance to be inferior since the p and γ phases are precipitated. It has been found that this can be solved by adding a suitable amount of Sn to the β and γ phases.

Accordingly, in Examples (b) to (d), at the time of dissolving starting materials of Step 1, Sn is contained therein and Sn is to be contained in the β and γ phases in a suitable amount by effecting a suitable temperature control at the time of the P or γ phase making annealing treatment, whereby it is possible to satisfy all of ensuring cold ductility at cold working, ensuring machinability and polishability at machining and polishing, and ensuring corrosion resistance.

Here, by referring to Example (c) as an example, a starting composition at Step 1, a crystal structure before cold drawing at Step 7, and a crystal structure and physical properties before machining and polishing procedure are shown in FIG. 11. Incidentally, at the time of β phase making annealing of Step 10, a crystal grain size fining treatment is simultaneously to be carried out.

First, when referring to the starting composition, whereas an apparent Zn content of Comparative example 1 is 35% by wt., the apparent Zn contents of Examples 1 to 4 all exceed the value. Here, if the apparent Zn content is too high, it is difficult to enlarge an α phase ratio at cold working and a γ phase which inhibits cold ductility at the time of the α phase making annealing is likely precipitated. On the other hand, if the apparent Zn content is too low, it is difficult to enlarge a P-phase ratio after cold working. Thus, the apparent Zn content is suitably within the range of 33.5 to 43.5% by wt.

Next, as for a Pb content, if it is too high, cold ductility is lowered so that in Examples 1 to 4, it is made 0.07% by wt. or less. This is the same as in Comparative example 1.

Next, as for an Sn content, whereas Comparative example 1 does not contain it, Examples 1 to 4 contain 0.5 to 2.0% by wt. This is to improve corrosion resistance by ensuring an Sn concentration in the β phase as mentioned above. If the Sn content is too high, a γ phase is likely precipitated during cold working and inhibits cold ductility so that it is determined the above range.

Next, when the crystal structure before cold drawing is compared, Examples 1 to 4 show lower α phase area ratios and smaller values in crystal grain size as compared with Comparative example 1. However, if the area ratio of the a phase is 90% or higher, elongation (showing cold ductility) of not less than 20% can be ensured, and there is no substantial hindrance in cold drawing so that there is no problem in Examples 1 to 4. Incidentally, when the area ratio of the α phase becomes 95% or higher, elongation of 35% or more is ensured so that it becomes the same as that of Comparative example 1.

Finally, when the crystal structure and physical properties before the machining and polishing process are compared, Examples 1 to 4 show high β phase area ratios, small average crystal grain sizes, high Sn concentrations in the a and β phases and good characteristics as for polishability, machinability and corrosion resistance as compared with Comparative example 1. As for the casual relation of these, the high β phase area ratio and the small average crystal grain size contribute to the polishability, the high β phase area ratio contributes to the machinability and the small average crystal grain size and the high concentration of Sn in the α and β phases contribute to the corrosion resistance as described above. Incidentally, the small average crystal grain size also contributes to improve strength and to inhibit surface roughness after bending process.

Here, as for polishability, evaluation is synthetically carried out in the viewpoints that 1. surface roughness after polishing is small as compared with the conventional material when polishing is carried out under the same conditions, 2. a polished amount is large as compared with the conventional material when polishing is carried out under the same conditions, 3. there is no defect in appearance and plating coverage is good as compared with the conventional material when polishing is carried out under the same conditions, and the evaluation lower than the conventional material was evaluated as poor (X), and the evaluation higher than the conventional material was evaluated as good (○).

Figure 12:
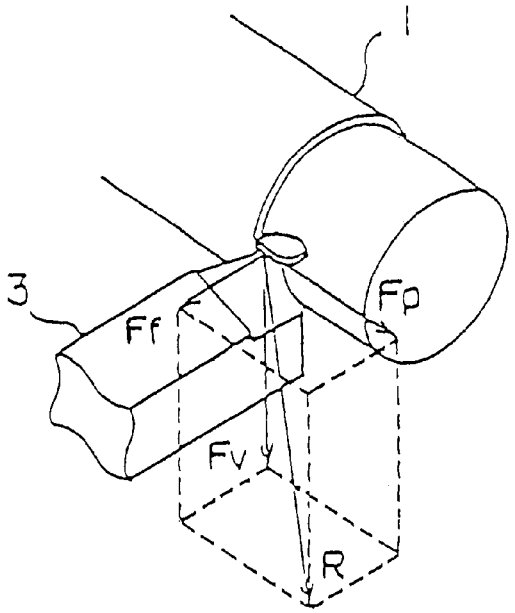
FIG. 12 is an explanation drawing of a machining test in the embodiment.

As for machinability, as the results of the machining test mentioned below, a machining resistance index using a free-cutting brass bar (JIS C-3604) as a standard of less than 50 was evaluated as poor (X) and 50 or higher was evaluated as good (○). In the machining test, as shown in FIG. 12, while machining a circumferential surface of a round bar Sample 1 by a lathe with two different machining rates of 100 [m/min] and 400 [m/min], a main component force Fv was measured. The machining resistance indexes of the respective examples are each a percentage of the main component force of the respective examples based on the main component force of the free-cutting brass bar which is said to be most excellent in machinability. (machining resistance indexes of respective machining rates are averaged.)

The corrosion resistance was evaluated in accordance with judgment criteria shown by a technical standard (JBMA T-303) of Japan Brass Makers Association on the result of at dezinking tests conducted in accordance with the JBMA T-303. That is, in the case where the direction of dezinking penetration depth is parallel with the working direction, the maximum dezinking depth of 100 μm or less was evaluated as good(○), and in the case where the direction of dezinking penetration depth is rectangular with the working direction, the maximum dezinking depth of 70 μm or less was evaluated as good(○). The results that do not satisfy these criteria was decided as poor(X).

An area ratio of the w phase is required to be at least 5% or so to ensure machinability and polishability, and for ensuring corrosion resistance, it may satisfy 30% or less, preferably 20% or less and an Sn concentration in the β phase of 1.5% by wt. or higher. Also, an average crystal grain size may satisfy 50 μm, preferably 25 μm or smaller.

Also, in the modified example in which the γ phase ratio is to be increased in place of increasing the β phase ratio, by containing 1% or higher of the area ratio of the γ phase, substantially the same polishability and machinability as those of Examples 1 to 4 in FIG. 11 can be obtained. Incidentally, the γ phase has a brittle property so that it is desirable to make the area ratio thereof 30% or less, an average crystal grain size (short diameter) of 8 μm or smaller, preferably 5 μm or smaller.

Moreover, by making the Sn concentration in the γ phase 8% by wt. or higher, and making the γ phase so as to surround the β phase, substantially the same corrosion resistance as those of Examples 1 to 4 in FIG. 11 can be obtained.

In FIG. 11 shown above, Example (c) is referred to as an example, and other embodiments in connection with Examples (c) and (e) are shown in FIG. 13.

In FIG. 13, Examples 5 to 7, 9, 10 and 12 are samples to which the β phase making annealing according to Example (c) is applied, and Examples 8 and 11 are samples to which the γ phase making annealing according to Example (c) is applied.

Also, various kinds of physical properties are evaluated as shown below.

*1; Polishability: Evaluated by the surface roughness after polishing, a polished amount, and appearance after plating.

*2; Machinability: Machining resistance index using free-cutting brass bar (JIS C3604) as a standard of less than 50 is evaluated as X, and 50 or more as ○.

*3; Corrosion resistance: In a dezinking corrosion test according to Japan Brass Makers Association Technical Standard (JBMA T-303), the maximum dezinking depth of 70 μm or less which is perpendicular to the forming direction is evaluated as ○, and exceeding 70 μm as X.

*4; Bending property: Evaluated by the presence or absence of the surface crack after bending of R25 and by the surface roughness state.

*5; SCC resistance: Evaluated by a breakage time when a load of a force resistance ratio of 50% is applied to in 3 vol % NH3 vap.

*6; Strength: In a tensile test, σ 0.2 of 140 $N/mm^2$ or higher is evaluated as ○, and less than 140 $N/mm^2$ as X.

*7; Elongation: In a tensile test, an elongation of 30% or more is evaluated as ○, and less than 30% as X.

*8; Hardness: In Vickers hardness, Hv of 85 or higher is evaluated as ○, and Hv of less than 85 as X.

*9; Erosion corrosion: Evaluated by performing a water passing test using a corrosive solution and observing the sectional structure after the test.

As can be seen from FIG. 13, there are some fluctuation in other physical properties, but as for the polishability, the machinability and the bending property, all of Examples 5 to 12 are superior to Comparative example 1.

Next, by referring to Example 8 as an example, the polishability which is quantitatively measured is shown.

FIG. 14 is evaluated by a surface finishing rate when polishing is carried out by an automatic polishing device for sample (Viewler ECOMET IV) under the same conditions.

<#600 polishing> A polishing plate rotation number of 150 rpm, a sample pressing pressure of 6.9 KPa, polishing paper of #600, sample initial surface of #80 finishing.

<Buffing> A polishing plate rotation number of 200 rpm, a sample pressing pressure of 6.9 KPa, polishing powder of $Al_2O_3$; 0.3 μm, sample initial surface of #600 finishing.

As can be seen from FIG. 14, in each of polishing, Example 8 was finished in polishing with a half time of Comparative example 1.

Subsequently, by referring to Examples 7 and 8 as examples, evaluation results of corrosion resistance at the straight portion and the bent portion after bending are shown in FIG. 15.

As can be seen from FIG. 15, in both of the straight portion and the bent portion, Examples 7 and 8 are superior to Comparative examples 1 and 2.

As other embodiments which are different from those as mentioned above, there is a method of accomplishing to combine ensuring cold ductility at cold working and ensuring machinability and polishability at machining and polishing even when the above-mentioned β phase making annealing treatment or γ phase making annealing treatment is not used. It is a method of precipitating a spherical y phase having an average crystal grain size of 8 μm or smaller, preferably 5 μm or smaller with an area ratio of 3 to 30%. According to this method, the spherical γ phase is hardly broken at the time of cold working so that no hindrance is caused to cold ductility, and at the time of machining and polishing, due to the difference in hardness at the grain fields of the γ phase and the other crystal phase to ensure machinability and polishability.

What is claimed is:

1. A brass material produced by cold working which comprises an α phase and a β phase, the α phase having an area ratio of 99% or less, the β phase having an area ratio of 5% to 40%, and said β phase having a Sn concentration of 1.5% by wt. or more.

2. The brass material according to claim 1, wherein the brass material has an average crystal grain size of 50 μm or smaller.

3. A method for producing a brass material according to claim 1 which comprises a heat treatment step to increase an area ratio of crystal phases other than an α phase after extrusion or rolling.

4. The method for producing a brass material according to claim 3, wherein the heat treatment step is to increase an area ratio of a β phase.

5. The method for producing a brass material according to claim 3 or 4, wherein an apparent Zn content is 33.5 to 43% by wt. as a starting material composition.

6. The method for producing a brass material according to claim 5, wherein the material is heated in the heat treatment step to the temperature region of 550 to 800° C. and the apparent Zn content is 33.5 to 43% by wt., or the material is heated in the heat treatment step to either the temperature region of 550 to 800° C. or of 400 to 500° C. and the apparent Zn content is 38.5 to 43% by wt.

7. The method for producing a brass material according to claim 2, wherein the heat treatment step comprises increasing an area ratio of the β phase by heating and then rapidly cooling to obtain a desired area ratio of the β phase.

8. The method for producing a brass material according to claim 7, wherein rapidly cooling is carried out at a cooling rate of 5° C./sec or higher down to 400° C. when the heating temperature region is 550 to 800° C., and at a cooling rate of 1° C./sec or higher down to 400° C. when the heating temperature region is 400 to 500° C.

9. The method for producing a brass material according to claim 4, wherein the area ratio of the β phase is 5% or more after the heat treatment step.

10. The method for producing a brass material according to claim 3, wherein cold working is carried out before said heat treatment step.

11. The method for producing a brass material according to claim 3, wherein crystal grain size fining treatment is carried out during said heat treatment step or in the steps prior to said heat treatment step.

12. The method for producing a brass material according to claim 11, wherein said crystal grain size fining treatment is carried out by recrystallization of transformation introduced by cold working under heating.

13. The method for producing a brass material according to claim 12, wherein said cold working is carried out with a sectional area reducing ratio of 20% or more.

14. The method for producing a brass material according to claim 11, wherein an average crystal grain size is 50 μm or smaller after said crystal grain size fining treatment.

15. The method for producing a brass material according to claim 3, wherein a machining resistance index using a free-cutting brass bar as a standard and measured according to Japanese Industrial Standard JIS C-3604 is 50 or higher after said heat treatment step.

16. The method for producing a brass material according to claim 3, wherein a starting material contains Sn, and when dezinking tests conducted in accordance with the technical standard T-303 of JBMA (Japan Brass Makers Association) are carried out with the direction of dezinking penetration depth is parallel with the working direction, the maximum dezinking depth is not deeper than 100 μm, and if the direction of dezinking penetration depth is rectangular with the working direction, the maximum dezinking depth is not deeper than 70 μm.

17. The method for producing a brass material according to claim 3, wherein a pipe material is produced.

18. The method for producing a brass material according to claim 17, wherein said pipe material is formed by casting and extrusion after casting.

19. The method for producing a brass material according to claim 17, wherein said pipe material is prepared from a plate material subjected to bending fabrication, and then joining an edge portion thereof.

20. The method for producing a brass material according to any one of claims 17 to 19, wherein when a flaw of #80 is surface polished under the conditions of the polishing device of Viewler ECOMET IV, a polishing plate rotation number of 200 rpm, a sample pressing pressure of 6.9 KPa and a polishing paper of SiC #600 after said heat treatment step, polishing is finished within a time of ½ as compared with the brass pipe material according to Japanese Industrial Standard JIS C-2700.

21. The method for producing a brass material according to any one of claims 17 to 19, wherein when a flaw of #600 is surface polished under the conditions of the polishing device of Viewler ECOMET IV, a polishing plate rotation number of 150 rpm, a sample pressing pressure of 6.9 KPa and polishing powder of $Al_2O_3$ after said heat treatment step, polishing is finished within a time of ½ as compared with the brass pipe material according to Japanese Industrial Standard JIS C-2700.

22. The method for producing a brass material according to any one of claims 17 to 19, wherein said pipe material contains Sn as a starting material composition and subjected to bending, and the bent portion satisfies the maximum dezinking penetration depth of 70 μm or less when a dezinking corrosion test according to Japan Brass Makers Association Technical Standard JBMA T-303 is carried out after said heat treatment step.

23. The method for producing a brass material according to any one of claims 17 to 19, wherein when a flaw of #600 is surface polished under the conditions of the polishing device of Viewler ECOMET IV, a polishing plate rotation number of 150 rpm, a sample pressing pressure of 6.9 KPa and polishing powder of $Al_2O_3$, polishing is finished within a time of ½ as compared with the brass pipe material according to Japanese Industrial Standard JIS C-2700.

24. A brass material produced by cold working which comprises an α phase and a γ phase, the α phase having an area ratio of 99% or less, and the γ phase having an area ratio of 1% or more, wherein a Sn concentration in said γ phase is 8% by wt.

25. A method for producing a brass material according to claim 24, which comprises a heat treatment step to increase an area ratio of a γ phase.

26. The method for producing a brass material according to claim 25, wherein an apparent Zn content is 33.5 to 43% by wt. and an Sn content is 0.5 to 1.3% by wt. as a starting material composition.

27. The method for producing a brass material according to claim 25, wherein an apparent Zn content is 33.5 to 43% by wt. and an Sn content is 1.3 to 2.0% by wt. as a starting material composition.

28. The method for producing a brass material according to any one of claims 25 to 27, wherein said heat treatment step is carried out by heating to the temperature region of 400 to 500°C. and an apparent Zn content is 33.5 to 43% by wt. and an Sn content is 0.5 to 2.0% by weight.

29. The method for producing a brass material according to claim 25, wherein the area ratio of the γ-phase is 1% or more after said heat treatment step.

30. In a method for producing a brass material according to claim 1 or 24, the improvement which comprises carrying out a step for refining crystal grain sizes after cold working.

31. The brass material according to claim 24, which further comprises a β phase; and the α phase surrounds the β phase.

32. A brass pipe material which comprises an apparent Zn content of 33.5 to 43% by wt., a Sn content of 0.5 to 1.3% by wt. and a γ phase.

33. A brass pipe material which comprises an apparent Zn content of 33.5 to 43% by wt., a Sn content of 1.3 to 2.0% by wt. and a γ phase.

34. A brass material produced by cold working which comprises an α phase and a γ phase, the α phase having an area ratio of 99% or less, and the γ phase having an area ratio of 1 to 30%, wherein a Sn concentration in said γ phase is 8% by wt. or more.

35. A brass material produced by cold working which comprises an α phase and a γ phase, the α phase having an area ratio of 99% or less, and the γ phase having an area ratio of 1% or more , wherein an average crystal grain size (short axis) of said γ phase is 8 μm or smaller, and a Sn conecntration in said γ phase is 8% by wt. or more.

36. A brass material produced by cold working which comprises an α phase and a γ phase, the α phase having an area ratio of 99% or less, and the γ phase having an area ratio of 1 to 30%, wherein an average crystal grain size (short axis) of said γ phase is 8 μm or smaller, and an Sn concentration in said γ phase is 8% by wt. or more.

37. A brass material produced by cold working which comprises an α phase, a β phase and a γ phase, the α phase having an area ratio of 99% or less, and the γ phase having an area ratio of 1% or more, wherein a Sn concentration in said γ phase is 8% by wt. or more, and the γ phase surrounds the β phase.

38. A brass material produced by cold working which comprises an α phase, a β phase and a γ phase, the α phase having an area ratio of 99% or less, and the γ phase having an area ration of 1 to 30%, wherein a Sn concentration in said γ phase is 8% by wt. or more, and the γ phase surrounds the β phase.

39. A brass material produced by cold working which comprises an α phase, a β phase and a γ phase, the α phase having an area ratio of 99% or less, and the γ phase having an area ratio of 1% or more, wherein the average crystal grain size (short axis) of said γ phase is 8 μm or smaller, and a Sn concentration in said γ phase is 8% by wt. or more, and the γ phase surrounds the β phase.

40. A brass material produced by cold working which comprises an α phase, a β phase and a γ phase, the α phase having an area ratio of 99% or less, and the γ phase having an area ratio of 1% to 30%, wherein the average crystal grain size (short axis) of said γ phase is 8 μm or smaller, and a Sn concentration in said γ phase is 8% by wt. or more, and the γ phase surrounds the β phase.

* * * * *